US011089425B2

(12) United States Patent
Lee et al.

(10) Patent No.: US 11,089,425 B2
(45) Date of Patent: Aug. 10, 2021

(54) AUDIO PLAYBACK METHOD AND AUDIO PLAYBACK APPARATUS IN SIX DEGREES OF FREEDOM ENVIRONMENT

(71) Applicant: LG ELECTRONICS INC., Seoul (KR)

(72) Inventors: Tung Chin Lee, Seoul (KR); Sejin Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/626,692

(22) PCT Filed: Nov. 14, 2017

(86) PCT No.: PCT/KR2017/012875

§ 371 (c)(1),
(2) Date: Dec. 26, 2019

(87) PCT Pub. No.: WO2019/004524

PCT Pub. Date: Jan. 3, 2019

(65) Prior Publication Data

US 2020/0162833 A1 May 21, 2020

Related U.S. Application Data

(60) Provisional application No. 62/525,687, filed on Jun. 27, 2017.

(51) Int. Cl.
*H04S 7/00* (2006.01)
*G10L 19/008* (2013.01)
(Continued)

(52) U.S. Cl.
CPC ..... *H04S 7/303* (2013.01); *G10L 19/008* (2013.01); *H04R 5/02* (2013.01); *H04R 5/04* (2013.01); *H04S 1/007* (2013.01); *H04S 2420/01* (2013.01)

(58) Field of Classification Search
None
See application file for complete search history.

(56) References Cited

U.S. PATENT DOCUMENTS 6,366,971 B1 4/2002 Ando et al.
7,492,915 B2 2/2009 Jahnke
(Continued)

FOREIGN PATENT DOCUMENTS

KR 1020160039201 A 4/2016
KR 10201600469800 A 4/2016
WO 2014021588 A1 2/2014

*Primary Examiner* — Qin Zhu
(74) *Attorney, Agent, or Firm* — Dentons US LLP

(57) ABSTRACT

The present invention pertains to an audio playback method and an audio playback apparatus in a 6DoF environment. The audio playback method of the present invention is characterised by comprising: a decoding step of decoding a received audio signal, and outputting the decoded audio signal and metadata; a modelling step of receiving input of position information of a user, checking whether the position of the user has changed from a previous position, and if the position of the user has changed, modelling binaural rendering data so as to correspond to the changed position of the user; and a rendering step of binaural-rendering the decoded audio signal using the modelled rendering data, and outputting the same as a two-channel audio signal. The audio playback method and apparatus in a 6DoF environment according to an embodiment of the present invention uses position change information of a user, changes the volume and depth of a sound source together according to the position of a user, and can thereby facilitate playback of a stereoscopic and realistic audio signal.

12 Claims, 18 Drawing Sheets

(51) Int. Cl.

| | |
|---|---|
| ***H04R 5/02*** | (2006.01) |
| ***H04R 5/04*** | (2006.01) |
| ***H04S 1/00*** | (2006.01) |
| ***H04S 3/00*** | (2006.01) |

(56) References Cited

U.S. PATENT DOCUMENTS

| | | | | |
|---|---|---|---|---|
| 2009/0043591 | A1* | 2/2009 | Breebaart | G10L 19/008 704/500 |
| 2016/0142854 | A1* | 5/2016 | Fueg | H04S 3/004 381/22 |
| 2016/0232901 | A1* | 8/2016 | Ghido | G10L 19/008 |
| 2016/0266865 | A1* | 9/2016 | Tsingos | H04R 5/04 |
| 2017/0366914 | A1* | 12/2017 | Stein | H04S 7/303 |
| 2018/0151185 | A1* | 5/2018 | Breebaart | G10L 19/008 |
| 2018/0210695 | A1* | 7/2018 | Tsingos | G06F 3/162 |
| 2019/0246236 | A1* | 8/2019 | Ehara | H04S 7/304 |
| 2020/0094141 | A1* | 3/2020 | Fersch | H04S 3/008 |

* cited by examiner

FIG. 13

| Syntax | No. of bits | Mnemonics |
|---|---|---|
| mpegh3daLocalSetupInformation0 | | |
| { | | |
| is6DoFMode 1301 | 1 | bslbf |
| if(is6DoFMode){ 1301a | | |
| up_az; 1302 | 9 | uimsbf |
| up_el; 1303 | 8 | uimsbf |
| up_dist; 1304 | 10 | uimsbf |
| } | | |
| bsRenderingType 1305 | 1 | uimsbf |
| switch (bsRenderingType){ | | |
| case 0 | | |
| LoudspeakerRendering() 1305a | | |
| case 1 | | |
| BinauralRendering() 1305b | | |
| } | | |
| bsNumWIREoutputs 1306 | 16 | uimsbf |
| if (bsNumWIREoutputs > 0){ | | |
| for (n = 0; n < bsNumWIREoutputs;n++){ | | |
| → WireID[n]; 1307 | 16 | uimsbf |
| } | | |
| } | | |
| hasLocalScreenSizeInformation; 1308 | 1 | bslbf |
| if (bsNumWIREoutputs > 0){ | | |
| LocalScreenSizeInformation(); | | |
| } | | |
| } | | |

FIG. 14

| Syntax | No. of bits | Mnemonics |
|---|---|---|
| LoudspeakerRendering() 1305a | | |
| { | | |
| bsNumLoudspeakers; 1401 | 16 | uimsbf |
| localLoudspeakerSetup = SpeakerConfig3d() | | |
| if(!is6DoFMode*) 1301b | | |
| { | | |
| hasLOudspeakerDistance 1402 | 1 | bslbf |
| hasLOudspeakerCalibrationGain 1403 | 1 | bslbf |
| useTrackingMode 1404 | 1 | bslbf |
| } | | |
| for(n = 0; n < bsNumLoudspeakers;n++){ | | |
| if(speakerLayoutType<=1){ | | |
| → hasKnownPosition[n] 1405 | 1 | bslbf |
| → if(is6DoFMode \|\| hasKnownPosition[n]){ 1301c | | |
| → loudspeakerAzimuth[n] 1406 | 9 | uimsbf |
| → loudspeakerElevation[n] 1407 | 8 | uimsbf |
| → } | | |
| } | | |
| if(is6DoFMode \|\| hasLoudspeakerDistance){ 1301d | | |
| → loudspeakerDistance[n] 1408 | 10 | uimsbf |
| } | | |
| if(is6DoFMode \|\| hasLoudspeakerCalibrationGain){ 1301e | | |
| → loudspeakerCalibrationGain[n] 1409 | 7 | uimsbf |
| } | | |
| } | | |
| externaldIstanceCompensation 1410 | 1 | bslbf |
| } | | |

*given by mpegh3dalocalSetupintormation()

FIG. 15

| Syntax | No. of bits | Mnemonics |
|---|---|---|
| mpegh3daElementInteraction() | | |
| { | | |
| ei_InteractionSignaltureDataLength | 8 | uimsbf |
| if (ei_InteractionSignatureDataLength > 0){ | | |
| ei_InteractionSighatureDataType | 8 | uimsbf |
| tor ( c = 0; c < ei_InteractionSignatureDataLength ; c ++){ | | |
| ei_InteractionSighatureData[c] | 8 | uimsbf |
| } | | |
| } | | |
| if (is6DoFMode*){ — 1301f | | |
| isUserPosChange — 1501 | 1 | bslbf |
| } | | |
| ElementInteractionData() | | |
| hasLocalZoomAreaSize | 1 | bslbf |
| it (hasLocalZoomAreaSize){ | | |
| LocalZoomAreaSize() | | |
| } | | |
| } | | |
| *given by mpegh3daLocalSetupIntormation() | | |

FIG. 16

| Syntax | No. of bits | Mnemonics |
|---|---|---|
| BinauralRendering() 1305b | | |
| { | | |
| bsFileSignature | 32 | bslbf |
| bsFileVersion | 8 | uimsbf |
| bsNumCharName | 8 | uimsbf |
| if(i=0; i<bsNumCharName; i ++){ | | |
| bsName[i] | 8 | bslbf |
| } | | |
| useHeadTrackingMode | 1 | bslbf |
| bsNumBinauralDataRepresentation | 4 | uimsbf |
| for (r = 0;r < bsNumBinauralDataRepresentation; r ++){ | | |
| brirSamplingFrequencyIndex | 5 | uimsbf |
| if (brirSamplingFrequencyIndex = = 0x1f) { | | |
| brirSamplingFrequency | 24 | uimsbf |
| } | | |
| if (is6DOFMode) 1301g | | uimsbf |
| { | | |
| bsNumLoudspeakers 1601 | 16 | |
| localLoudspeakerSetup = SpeakerConfig3d() | | |
| for (n = 0; n < bsNumLoudspeakers; n++){ | | |
| if (speakerLayoutType<=1){ | | |
| loudspeakerAzimuth[n] 1602 | 9 | uimsbf |
| loudspeakerElevation[n] 1603 | 8 | uimsbf |
| } | | |
| loudspeakerDistance[n] 1604 | 10 | uimsbf |
| loudspeakerCalibrationGain[n] 1605 | 7 | uimsbf |
| } | | |
| externalDistanceCompensation 1606 | 1 | bslbf |
| RIRGeneration() 1607 | | |
| HRIRGeneration() 1608 | | |
| } | | |
| else | | |
| { | | |

FIG. 17

| Syntax | No. of bits | Mnemonics |
|---|---|---|
| RIRGeneration()~~ 1607 | | |
| { | | |
| bsRIRDataFormatID;~~ 1701 | | |
| switch(bsRIRDataFormatID){ | 1 | bslbf |
| case 0 | | |
| RIRFIRData()~~ 1702 | | |
| break | | |
| case 1 | | |
| RIRModeling()~~ 1703 | | |
| break | | |
| } | | |

FIG. 18

| Syntax | No. of bits | Mnemonics |
|---|---|---|
| RIRFIRData() ~ 1702 | | |
| { | | |
| bsNumRIRCoefs ~ 1801 | 24 | uimsbf |
| bsNumLengthPosIdx ~ 1802 | 10 | uimsbf |
| bsNumWidthPosIdx ~ 1803 | 10 | uimsbf |
| | | |
| for (n=0; n<bsNumLoudspeakers; n++){ | | |
| for (i=0; i<bsNumRIRCoefs; i++){ | | |
| bsRIRFirCoef[n][i] ~ 1804 | 32 | bslbf |
| } | | |
| } | | |
| } | | |

FIG. 19

| Syntax | No. of bits | Mnemonics |
|---|---|---|
| RIRModeling()—— 1703 | | |
| { | | |
| bsNumRIRCoefs | 24 | uimsbf |
| // Room shape - Aassume the room has rectangular shape | | |
| RoomLength; | 10 | uimsbf |
| RoomWidth; | 10 | uimsbf |
| RoomHeight; | 10 | uimsbf |
| | | |
| // Absoprtion coeffidents of wall material | | |
| AbsorpCoeffCeil | 32 | uimsbf |
| AbsorpCoeffFloor | 32 | uimsbf |
| AbsorpCoeffWallFront | 32 | uimsbf |
| AbsorpCoeffWallBack | 32 | uimsbf |
| AbsorpCoeffWallLeft | 32 | uimsbf |
| AbsorpCoeffWallRight | 32 | uimsbf |
| | | |
| nTapFilter | 5 | uimsbf |
| for(tap=0;tap<nTapFilter;tap++){ | | |
| dly[tap] | 16 | uimsbf |
| gain_b[tap] → | 32 | uimsbf |
| gain_c[tap] → | 32 | uimsbf |
| A[tap][tap] → | 32 | uimsbf |
| b_af[tap] // absorbent filter of left channel | 32 | uimsbf |
| } | | |
| dly_direct; → → | 32 | uimsbf |
| tf_b // Tone correction filter | 32 | uimsbf |
| | | |
| for (n=0;n<bsNumLoudspeakers;n++){ | | |
| ERModeling()—— 1910 | | |
| } | | |
| } | | |

FIG. 20

| Syntax | No. of bits | Mnemonics |
|---|---|---|
| ERModeling()~~ 1910<br>{<br>ModelingMethod~~ 2001<br>} | 2 | uimsbf |

FIG. 21

| Syntax | No. of bits | Mnemonics |
|---|---|---|
| HRIRGeneration()~~ 1608<br>{<br>bsHRIRDataFormatID~~ 2101<br>switch(bsHRIRDataFormatID){<br>case 0<br>HRIRFIRData()~~ 2102<br>break<br>case 1<br>HRIRModeling()~~ 2103<br>break<br>}<br>} | 1 | bslbf |

FIG. 22

| Syntax | No. of bits | Mnemonics |
|---|---|---|
| HRIRFIRData() ~ 2102 | | |
| { | | |
| bsNumHRIRCoefs ~ 2201 | 24 | uimsbf |
| for (pos=0; n < nBrirPairs; pos++){ | | |
| for (i=0; i<bsNumHRIRCoefs; i++){ | | |
| bsFirHRIRCoefLeft[pos][i] ~ 2202 | 32 | bslbf |
| bsFirHRIRCoefRight[pos][i] ~ 2203 | 32 | bslbf |
| } | | |
| } | | |
| } | | |

FIG. 23

| Syntax | No. of bits | Mnemonics |
|---|---|---|
| HRIRModeling() ~ 2103 | | |
| { | | |
| bsNumHRIRCoefs ~ 2301 | 24 | uimsbf |
| HeadRadius ~ 2302 | 10 | uimsbf |
| PinnaModelIdx ~ 2303 | 3 | uimsbf |
| } | | |

AUDIO PLAYBACK METHOD AND AUDIO PLAYBACK APPARATUS IN SIX DEGREES OF FREEDOM ENVIRONMENT

CROSS REFERENCE TO RELATED APPLICATIONS

This application is a National Phase application of International Application No. PCT/KR2017/012875, filed Nov. 14, 2017, and claims the benefit of U.S. Provisional Application No. 62/525,687 filed on Jun. 27, 2017, all of which are hereby incorporated by reference in their entirety for all purposes as if fully set forth herein.

TECHNICAL FIELD

The present invention relates to an audio play method and audio play apparatus using the same. More particularly, the present invention relates to an audio play method and audio play apparatus for playing a three-dimensional audio signal in a six-Degree-of-Freedom (6-DoF) environment.

BACKGROUND ART

Recently, various smart devices have been developed in accordance with the development of IT technology. In particular, such a smart device basically provides an audio output having a variety of effects. In particular, in a virtual reality environment or a three-dimensional audio environment, various methods are being attempted for more realistic audio outputs. In this regard, MPEG-H has been developed as new audio coding international standard techniques. MPEG AVC-H is a new international standardization project for immersive multimedia services using ultra-high resolution large screen displays (e.g., 100 inches or more) and ultra-multi-channel audio systems (e.g., 10.2 channels, 22.2 channels, etc.). In particular, in the MPEG-H standardization project, a sub-group named "MPEG-H 3D Audio AhG (Adhoc Group)" is established and working in an effort to implement an ultra-multi-channel audio system.

An MPEG-H 3D Audio encoding/decoding device provides realistic audio to a listener using a multi-channel speaker system. In addition, in a headphone environment, a realistic three-dimensional audio effect is provided. This feature allows the MPEG-H 3D Audio decoder to be considered as a VR compliant audio standard.

A 3D audio provides a feeling like a sound source is played in a three-dimensional space instead of a head of a user, and transmits realistic sound by changing a position of the sound source localized to work to a time change and a view point viewed by a user.

In this regard, the existing 3D audio encoding/decoding equipment supports only up to 3 Degrees of Freedom (referred to as '3DoF'). The Degree of Freedom (DoF) may, for example, provide the most appropriate visual and sound for the position or posture of a user when a motion of a head in in a random space is accurately tracked. And, such a motion is divided into 3 Degrees of Freedom (3DoF) or 6 Degrees of Freedom (6DoF) depending on a motion-capable Degree of Freedom (DoF). For example, 3DoF means that a movement of the X, Y, and Z axes is possible, like a user does not move but rotates a head in a fixed position. On the other hand, 6DoF means that it is possible to move along the X, Y, and Z axes in addition to rotating about the X, Y, and Z axes. Hence, the 3DoF does not reflect a user's position motion and makes it difficult to provide a more realistic sound. Therefore, the present invention proposes a method for rendering audio in response to a user's position change in a 6DoF environment by applying a space scheme to a 3D audio encoding/decoding device.

In general, in a communication environment, an audio signal having a much smaller capacity is encoded in comparison with a video signal in order to maximize bandwidth efficiency. Recently, there are many technologies that can implement and experience VR audio contents that are increasingly interesting, but the development of a device capable of efficiently encoding/decoding the content is deficient. In this regard, as an encoding/decoding device capable of providing a three-dimensional audio effect, MPEG-H 3D Audio is being developed but has a problem of being limitedly usable only in the 3DoF environment.

Recently, in a 3D audio encoding/decoding device, a binaural renderer is used to experience three-dimensional audio through a headphone. However, since Binaural Room Impulse Response (BRIR) data used as an input to the binaural renderer is a response measured at a fixed location, it is valid only in a 3DoF environment. Besides, in order to build a VR environment, BRIR for a wide variety of environments is required, but it is impossible to secure BRIR for all environments as a DataBase (DB). Therefore, the present invention adds a function capable of modeling an intended spatial response by providing spatial information to a 3D audio encoding/decoding device. Further, the present invention proposes an audio play method and apparatus capable of using a 3D audio encoding/decoding device in a 6DoF environment by rendering a modeled response to work to a user's location by real time in a manner of user's location information simultaneously.

DISCLOSURE OF THE INVENTION

Technical Task

One technical task of the present invention is to provide an audio play method and apparatus for playing a three-dimensional audio signal in a 6DoF environment.

Another technical task of the present invention is to provide an audio play method and apparatus for playing a 3D audio signal in a 6DoF environment in a manner of modeling RIR, HRIR and BRIR data and using the modeled data.

Further technical task of the present invention is to provide an MPEG-H 3D audio play apparatus for playing a 3D audio signal in a 6DoF environment.

Technical Solutions

In one technical aspect of the present invention, provided herein is a method of playing an audio in a 6DoB environment, the method including a decoding step of decoding a received audio signal and outputting the decoded audio signal (decoded signal) and metadata, a modeling step of checking whether a user's position is changed from a previous position by receiving an input of user position information and modeling a binaural rendering data to be related to the changed user position if the user position is changed, and a rendering step of outputting a 2-channel audio signal by binaural-rendering the decoded audio signal (decoded signal) based on the modeled rendering data.

The modeling step may include a first modeling step of modeling RIR data by further receiving room characterization information and a second modeling step of modeling HRIR data by further receiving user head information.

The modeling step may further include a distance compensation step of adjusting a gain of the second-modeled HRIR data based on the changed user position.

The modeling step may further include a BRIR synthesizing step of generating BRIR data related to the changed user position by synthesizing the distance-compensated HRIR data and the first-modeled RIR data.

The method may further include a metadata processing step of receiving the user position information and adjusting the metadata to be related to the changed user position.

The metadata processing step may adjust at least one of speaker layout information, zoom area, or audio scene to be related to the changed user position.

The user position information may include an indicator flag (isUserPosChange) information indicating that the user position has been changed and information of at least one of azimuth, elevation, or distance related to the changed user position.

Indicator flag (is6DoFMode) information indicating whether or not the 6DoF environment is supported may be further received and based on the 6DoF environment supported by the indicator flag (is6DoFMode) information, the user position information may be received.

In one technical aspect of the present invention, provided herein is an apparatus for playing an in a 6DoF environment, the apparatus including an audio decoder decoding a received audio signal and outputting the decoded audio signal (decoded signal) and metadata, a modeling unit checking whether a user's position is changed from a previous position by receiving an input of user position information and modeling a binaural rendering data to be related to the changed user position based on the changed user position, and a binaural renderer outputting a 2-channel audio signal by binaural-rendering the decoded audio signal (decoded signal) based on the modeled rendering data.

The modeling unit may further include a first modeling unit modeling RIR data by further receiving room characterization information and a second modeling unit modeling HRIR data by further receiving user head information.

The modeling unit may further include a distance compensation unit adjusting a gain of the second-modeled HRIR data based on the changed user position.

The modeling unit may further include a BRIR synthesizing unit generating BRIR data related to the changed user position by synthesizing the distance-compensated HRIR data and the first-modeled RIR data.

The apparatus may further include a metadata processor receiving the user position information and adjusting the metadata to be related to the changed user position.

The metadata processor may adjust at least one of speaker layout information, zoom area, or audio scene to be related to the changed user position.

The user position information may include an indicator flag (isUserPosChange) information indicating that the user position has been changed and information of at least one of azimuth, elevation, or distance related to the changed user position.

Indicator flag (is6DoFMode) information indicating whether or not the 6DoF environment is supported may be further received and based on the 6DoF environment supported by the indicator flag (is6DoFMode) information, the user position information may be received.

Advantageous Effects

Effects of an audio play and apparatus in a 6DoF environment according to an embodiment of the present invention are described as follows.

Firstly, in order to apply to a 6DoF environment, it is possible to provide an audio signal having three-dimensional and realistic effects by changing the size and depth sensitivity of a sound source according to a position of a user by using user's position change information.

Secondly, by adding a space modeling scheme applied to a 6DoF environment, it is possible to provide an environment for enabling a user to enjoy VR contents even if a user's position is freely moved.

Thirdly, the efficiency of MPEG-H 3D Audio implementation can be enhanced using the next generation immersive-type three-dimensional audio encoding technique. Namely, in various audio application fields, such as a game, a Virtual Reality (VR) space, etc., it is possible to provide a natural and realistic effect in response to an audio object signal changed frequently.

DESCRIPTION OF DRAWINGS

FIGS. 13 to 23 are diagrams to describe a syntax structure utilized in an audio play method and apparatus according to an embodiment of the present invention.

BEST MODE FOR INVENTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module", "unit" and "means" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings. Moreover, although the present invention uses Korean and English texts are used together for clarity of description, the used terms clearly have the same meaning.

Figure 1:
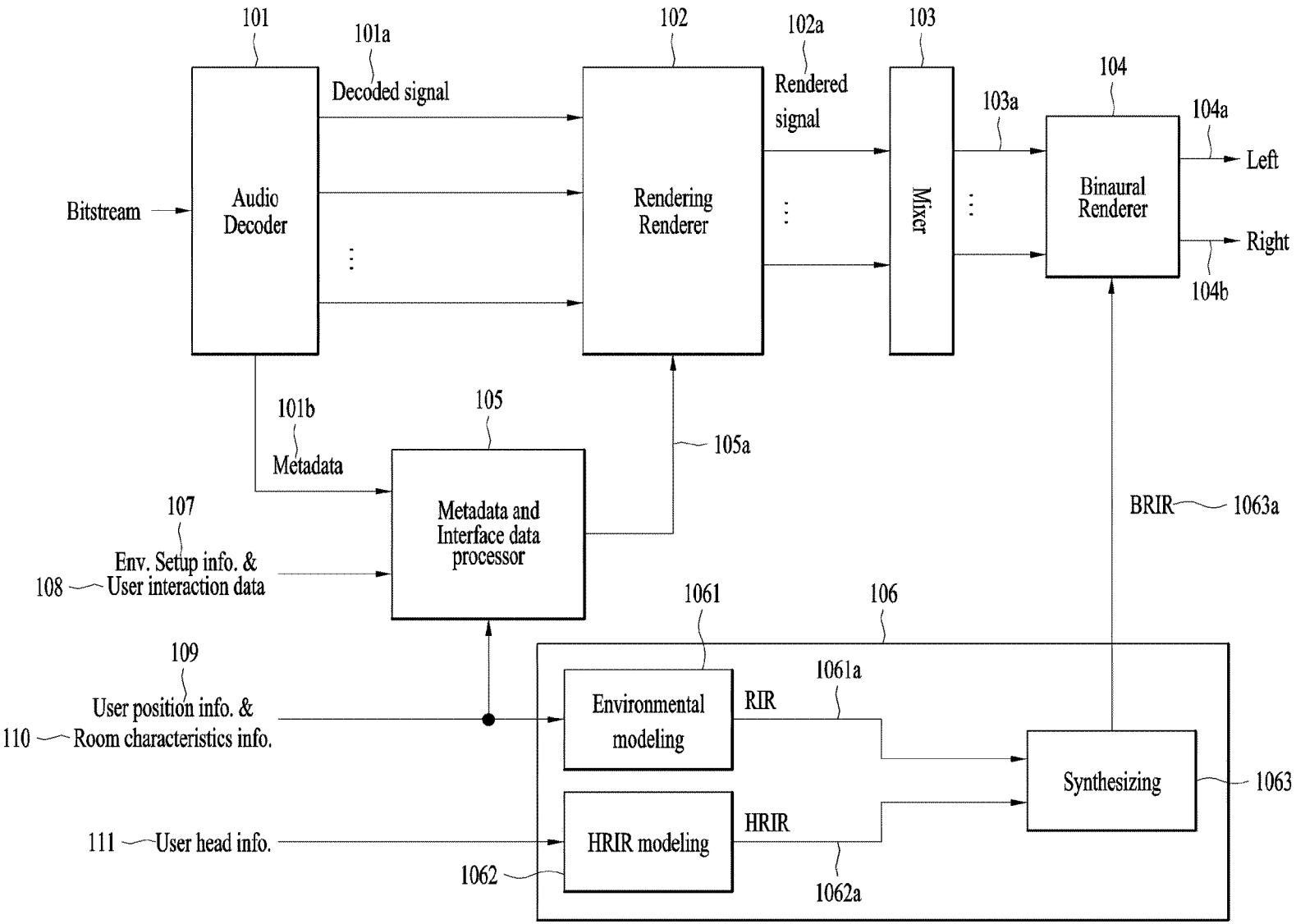
FIG. 1 illustrates an audio play apparatus according to the present invention.

FIG. 1 illustrates an audio play apparatus according to the present invention. The audio play apparatus of FIG. 1 includes an audio decoder 101, a renderer 102, a mixer 103, a binaural renderer 104, a metadata processor 105, and a rendering data modeling unit 106. The rendering data modeling unit 106 includes a first modeling unit (environmental modeling) 1061 for generating an RIR data 1061*a*, a second modeling unit (HRIR modeling) 1062 for generating an HRIR data 1061*b*, and a synthesizing unit (synthesizing) 1063 for synthesizing a BRIR data 1063*a* by synthesizing the RIR data 1061*a* and the HRIR data 1062*a* together. Hereinafter, the audio play apparatus of the present invention will be described in detail.

First of all, the audio decoder 101 receives an audio signal (e.g., an audio bitstream) and then generates a decoded audio signal (decoded signal) 101*a* and a metadata 101*b*. The metadata information 101*b* is forwarded to the metadata processor 105, and the metadata processor 105, in combination with a playback environment information (environment setup info) 107 inputted externally and additionally and a user interaction information (user interaction data) 108, sets up a final playback environment and then outputs a playback environment information 105*a* to the renderer 102. In this regard, the detailed operation of the metadata processor 105 will be described in detail with reference to FIG. 4.

The renderer 102 performs a rendering by applying to the decoded signal 101*a* inputted by a user to fit a speaker environment set up for a user with reference to the playback environment information 105*a* and then outputs a rendered signal 102*a*. The rendered signal 102*a* is outputted as a final channel signal 103*a* through gain and delay corrections at a mixer 103, and the outputted channel signal 103*a* is filtered with a BRIR 1063*a* in the binaural renderer 104 to output surround 2-channel binaural rendered signals 104*a* and 104*b*.

The BRIR 1063*a* is generated by combining the HRIR 1062*a* modeled through a user head information 111 and the RIR 1061*a* modeled through a user position information 109 and a room characterization information 110 together. Therefore, if the user position information 109 is changed, the first modeling unit (environment modeling) 1061 re-models the RIR with reference to a new position of the user, and a BRIR changed by the newly modeled RIR is generated. The changed BRIR is inputted to the binaural renderer 104 to finally render the inputted audio signal and output 2-channel binaural rendered signals 104*a* and 104 *b*.

Figure 2:
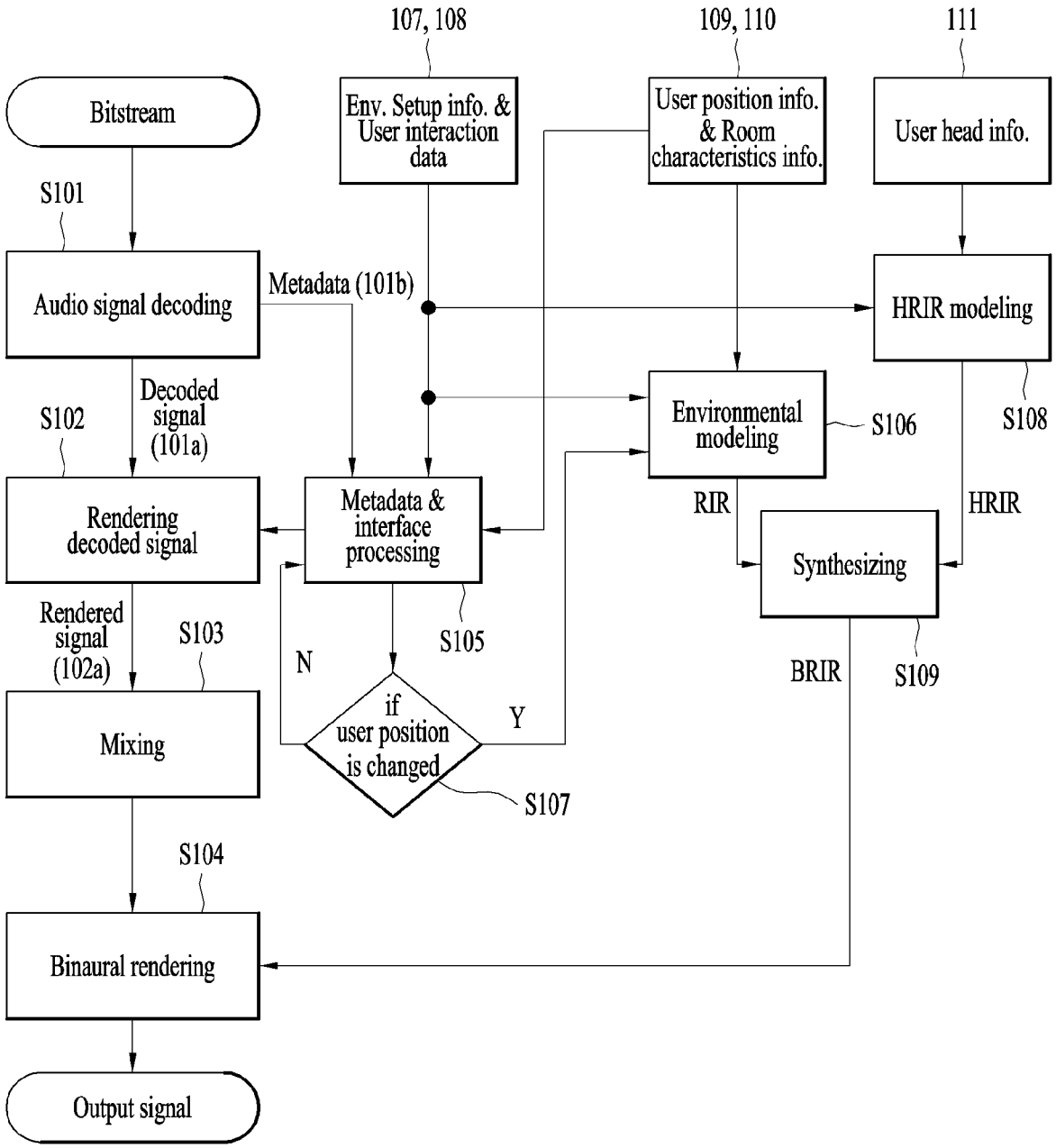
FIG. 2 is a flowchart illustrating an audio play method according to the present invention.

FIG. 2 is a flowchart illustrating an audio play method in the audio play apparatus according to the present invention.

A step S101 is a process of decoding an input audio signal and outputting the decoded audio signal (decoded signal) 101*a* and the metadata 101*b*.

A step S102 is a process of rendering the input decoded audio signal 101*a* based on the playback environment information 105*a*. In this regard, an object signal in the decoded audio signal 101*a* is rendered by applying metadata, which is modified through a step S105 described later, thereto.

As an optional process, a step S103 is a process of if there are more than two types of the rendered signal 102*a* or more, mixing the two types of signals. In addition, if necessary, a final channel signal is outputted through gain and delay corrections applied to the rendered signal 102*a*.

In a step S104, the rendered signal 102*a* or the output signal of the step S103 is filtered with the generated BRIR 1063*a* to output a surround 2-channel binaural audio signal.

In this regard, a detailed process of generating the BRIR 1063*a* will now be described as follows. In a step S105, the metadata 101*b* is received from the step S101, and the environment setup information 107 and the user position information 109 are received, and the audio playback environment is set up to output the playback environment information 105*a*. Moreover, the step S105 may modify and output the inputted metadata 101*b* with reference to the user interaction data 108 when necessary.

A step 106 receives inputs of the user position information 109 and the room characterization information 110, thereby outputting a modeled RIR 1061*a*.

A step S107 is a process of checking whether the user position information 109 received in the step S105 is changed from a previously received user position information. If the received user position information 109 is different from the previously received user position information (Y path), the RIR is re-modeled in the step S106 based on the new received user position information 109.

A step S108 is a process of receiving the user head information 111 and outputting HRIR modeled through HRIR modeling.

A step S109 is a process of generating a BRIR by synthesizing the RIR modeled in step S106 and the HRIR modeled in the step S108 together. The generated BRIR information is utilized to render the 2-channel binaural audio signal in the step S104 described above.

Figure 3:
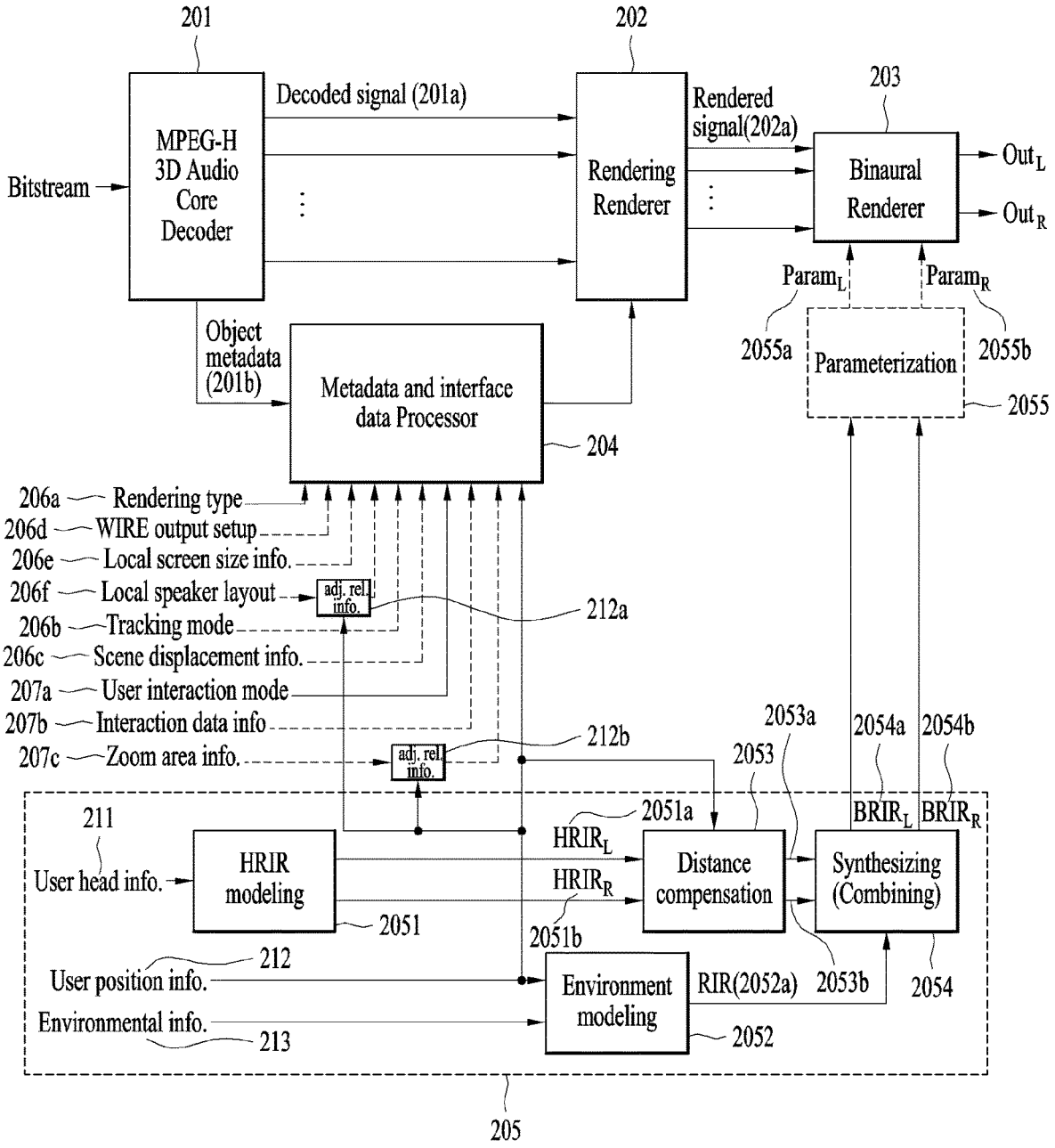
FIG. 3 illustrates an audio play apparatus according to an embodiment of the present invention.

FIG. 3 illustrates another embodiment for implementing the audio play apparatus of the present invention. In particular, FIG. 3 illustrates, for example, an audio play apparatus for implementing a 6DoF 3D audio based on MPEG-H 3D Audio encoder according to an embodiment of the present invention. The audio play apparatus of FIG. 3 includes an audio decoder (MPEG-H 3D Audio Core Decoder) 201, a renderer 202, a binaural renderer 203, a metadata processor (Metadata and Interface data processor) 204, and a rendering data modeling unit 205.

Hereinafter, the MPEG-H 3D audio play apparatus according to the embodiment of the present invention in FIG. 3 is described in detail as follows.

The audio decoder 201 receives an input of an audio bitstream. The audio bitstream is generated by encoding and bit-packing an audio signal inputted from a transmitting end (not shown) based on an MPEG-H 3D audio format. In this regard, an audio signal type may be a channel signal, an object signal, or a scene-based High Order Ambisonic (HOA) signal in case of generating of an MPEG-H 3D audio bitstream. Alternatively, a combination of the object signal and a different signal may be inputted (e.g., 'channel signal+object signal', 'HOA signal+object signal', etc.). The audio bitstream generated from the transmitting end (not shown) through the above process is inputted to the audio decoder (MPEG-H 3D Audio Core decoder) 201 so as to output a decoded signal 201*a*. The outputted decoded signals 201*a* are all signals that have been inputted from the transmitting end, and are outputted as the decoded signal 201*a* in order of the signal type encoded at the transmitting end. If an object signal is included in the audio signal, information of an object metadata 201*b* related to an object is outputted together as well when the decoded signal 201*a* is outputted.

Subsequently, the decoded signals 201*a* are forwarded to the renderer 202 and the information of the metadata 201*b* outputted together is forwarded to the metadata processor 204.

The metadata processor 204 may combine the object metadata 201*b* with configurable information inputted externally and additionally, thereby altering the characteristics of a final output signal. The externally and additionally configurable information mainly includes a playback environment setup information (environment setup info) 206 and a user interaction information (user interaction data) 207. The playback environment setup information may include, for example, a rendering type information 206*a* indicating whether to output to a speaker or a headphone, a tracking mode 206*b* indicating whether a head tracking is used, a scene displacement information 206*c* indicating whether an audio scene is displaced, and an information (WIRE output setup) 206*d* indicating an external connection device, a video local screen size information 206*e* linked to an audio, and an information (local speaker layout) 206*f* indicating a location of a speaker used.

In addition, as informations that give user intents during audio playback, the user interaction information 207 may include, for example, an interaction mode 207*a* and an interaction data (interaction data info.) 207*b* as informations indicating a change in the characteristics (location and size) of an object signal by a user and an information (Zoom area info.) 207*c* indicating a linkage between a video screen and an object.

Further, the metadata processor 204 should modify the object metadata 201*b* in a corresponding process to fit a user's intention when the user desires to change the characteristic information of a random object while the object signal is played. Therefore, the metadata processor 204 does not only set up a playback environment but also includes a process of modifying the object metadata 201*b* with reference to externally inputted informations.

The renderer 202 renders and outputs the decoded signal 201*a* according to the externally inputted playback environment information. If speakers of the playback environment of the user are less than the number of input channel signals, a channel converter may be applied to downmix the channel signal in accordance with the number of speakers of the playback environment, and the object signal is rendered to fit the playback speaker layout with reference to object metadata information for the object signal. In addition, for the HOA signal, the input signals are reconfigured to fit the selected speaker environment. In addition, if the decoded signal 201*a* is in the form of a combination of two types of signals, it is possible to mix the signals rendered to fit the output speaker layout in a mixing process so as to output the mixed signals as a channel signal.

In this regard, if a play type is selected as a headphone by the rendering type 206*a*, the binaural BRIRs recorded at the speaker layout in the playback environment are filtered in the rendered signal 202*a* and added to the rendered signal 202*a* so as to output the final 2-channel stereo signals $OUT_L$ and $OUT_R$. In this regard, since a large amount of computation is required when the binaural BRIRs are directly filtered in the rendered signal 202*a*, it is possible to extract and utilize BRIR parameter data 2055*a* and 2055*b* parameterized from feature informations of the BRIR through a process by a BRIR parameter generation unit (parameterization) 2055. Namely, by applying the extracted BRIR parameter data 2055*a* and 2055*b* directly to a signal, efficiency can be increased in terms of calculation amount. Yet, it is possible to selectively apply the BRIR parameter generation unit 2055 according to the actual product design.

In this regard, the rendering data modeling unit 205 of FIG. 3 includes an additionally extended process for effectively using the MPEG-H 3D Audio play apparatus in a 6DoF environment. This is described in detail as follows.

The rendering data modeling unit 205 is characterized in including a first modeling unit (environmental modeling) 2052 for generating an RIR data 2052*a*, a second modeling unit (HRIR modeling) 2051 for generating HRIR data 2051*a* and 2051*b*, a distance compensation unit (distance compensation) 2053 for compensating the HRIR data 2051*a* and 2051*b* in response to a change of a user position, and a synthesizing unit (synthesizing) 2054 for synthesizing the BRIR data 2054*a* and 2053*b* by synthesizing the RIR data 2052 and the compensated HRIR data 2053*a* and 2053*b* outputted from the distance compensation unit 2053. As described above, the present invention may include a BRIR parameter generation unit (parametrization) 2055 that parameterizes the synthesized BRIR data 2054*a* and 2054*b* selectively so as to output BRIR parameter data 2055*a* and 2055*b*.

In this regard, the present invention additionally receives a space environment information 213 and a user position information 212 in order to support a 6DoF environment, and also enables a personalized HRIR to be usable by receiving a user head information 211 to provide the most optimized stereo sound to a listener. Namely, when a user moves a position within a random space (e.g., it is possible to confirm whether the user position is moved from a presence or non-presence of a change of the received user position information 212), relative positions of the object metadata and the speaker are changed together, and thus, as shown in FIG. 3, the data adjusting units (adjust relative information (adj. ref. info.) 212*a* and 212*b* are added to compensate information changed according to a user position movement.

The first modeling unit (environmental modeling) 2052 is a process of modeling a Room Impulse Response (RIR). For example, in a 6DoF environment, a user is free to move within a space where a sound source is generated. Thus, depending on a position the user moves, a distance between the user and the sound source varies, whereby a room response is changed. For example, when a user is very close to a sound source in a space such as a church, where the reverberation is highly sound, sound source sounds are greatly heard, but if the sound source is far away from the sound, the sound source sounds become small and the reverberation becomes larger. Since this effect is a phenomenon in which the user moves the position within the same space, a space response should be modeled using the user's position information and the room characterization information in order to reflect the feature that varies with the change of the position in the 6DoF environment. The operation of the first modeling unit 2052 will be described in detail with reference to FIGS. 5 to 8.

The second modeling unit 2051 is a process for modeling the features of user's head and ears. Because the features of the head and ears are different for each person, it is necessary to model HRIR by accurately reflecting shapes of the user's head and ears in order to effectively experience a three-dimensional audio for VR contents. A specific operation of the second modeling unit 2051 will be described in detail with reference to FIGS. 9 to 11.

The distance compensation unit 2053 adjusts the gains of the modeled HRIR response ($HRIR_L$) 2051*a* and the modeled HRIR response ($HRIR_R$) 2051*b* by reflecting the user position information 212. Generally, the HRIR is measured or modeled in a situation where a distance between a user and a sound source is kept constant at all times. However, since the distance between the user and the sound source is changed in the space where the user can freely move on the space like the 6DoF environment, a gain of the HRIR response should be also changed. (e.g., the closer the user gets to the sound source, the larger the HRIR response size becomes. The farther the user gets away from the sound source, the smaller the HRIR response size becomes.) For this reason, the binaural HRIR gains should be adjusted according to a user's position. The specific operation of the distance compensator 2053 will be described in detail with reference to FIG. 12.

The synthesizing unit (synthesizing) 2054 synthesizes the modeled $HRIR_L$ 2051*a* and $HRIR_R$ 2051*b* and the RIR 2052*a*. That is, in order to experience a realistic audio using a headphone in a VR environment, a BRIR response, which reflects user's head and ear characteristic information and room characterization information together, is required. Thus, the modeled $HRIR_L$ 2051*a* and $HRIR_R$ 2051*b* are synthesized with the room response RIR 2052*a*, thereby producing responses of a $BRIR_L$ 2054*a* and a $BRIR_R$ 2054*b*. The $BRIR_L$ 2054*a* and a $BRIR_R$ 2054*b* may be filtered in the directly rendered signal 202*a* so as to output final output signals $OUT_L$ and $OUT_R$ that are binaurally rendered. And, as described above, if necessary, feature information of the binaural BRIR ($BRIR_L$ and $BRIR_R$) is extracted as parameters through the BRIR parameterization 2055, whereby the final output signals $OUT_L$ and $OUT_R$ may be outputted by applying $Param_L$ 2055*a* and the $Param_R$ 205*b* thereto.

Figure 4:
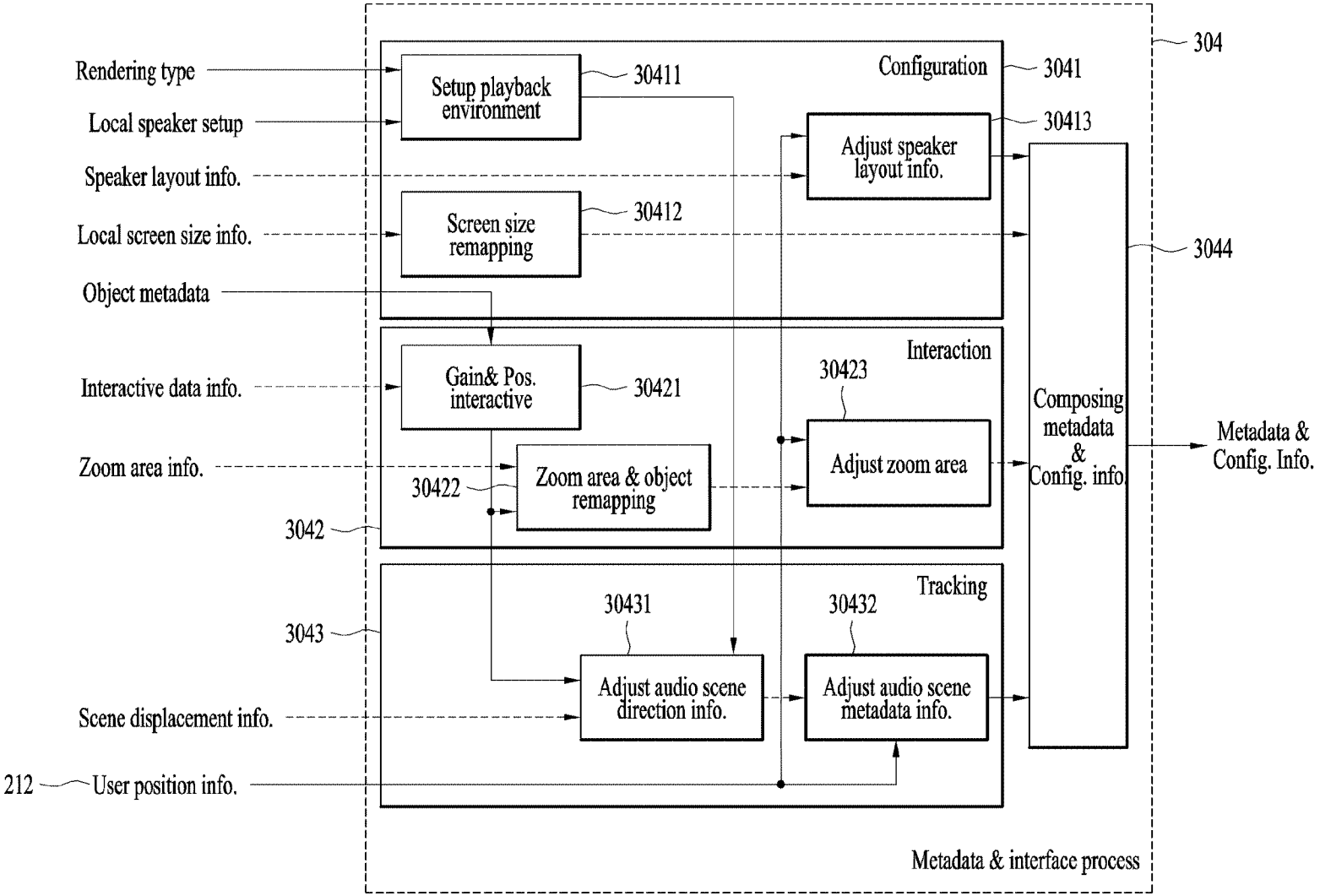
FIG. 4 illustrates another embodiment of a metadata processor in the audio play apparatus according to an embodiment of the present invention.

FIG. 4 illustrates another example of a metadata processor 304 in the audio play apparatus according to another embodiment of the present invention. Configuration of the metadata processor 304 of FIG. 4 differs from that of the metadata processor 204 of FIG. 3 in an implementation manner. For example, the metadata processor 304 of FIG. 4 performs self-data adjustment, whereas the metadata processor 204 of FIG. 3 receives an input of a signal adjusted through the aforementioned data adjusting units (adjust relative information (adj. ref. info.) 212*a* and 212*b*.

Hereinafter, the metadata processor (metadata & interface data processor) 304 in the 6DoF environment shown in FIG. 4 will be described in detail as follows. Referring to FIG. 4, the metadata processor 304 may be divided into a first part (configuration part) 3041 for setting up playback environment information, a second part (interaction part) 3042 for allowing a user to directly interact with an audio scene, and a third part (tracking part) 3043 for recognizing and compensating the movement of a user.

First of all, the first part (configuration part) 3041 is a part for setting up a sound source content playback environment and uses a rendering type, a local speaker setup, a speaker layout information, a local screen size information, and an object metadata information. The rendering type and the local speaker setup are inputted to a 'setup playback environment' 30411 to determine whether to play an audio signal through a speaker or headphones. In addition, the local speaker setup means a speaker format and uses a BRIR corresponding to a set-up speaker format in case of playback with headphones. The speaker layout information means layout information of each speaker. The layout of the speaker may be represented as an azimuth angle, an elevation angle, and a distance based on a view and position where a user is looking at a front side. The object metadata is an information for rendering an object signal in a space and contains information such as azimuth angle, elevation angle, gain, etc. for each object in a predetermined time unit. In general, object metadata is produced by considering a representation scheme of each object signal when a content producer constructs an audio scene, and the produced metadata is encoded and forwarded to a receiving end. When the object metadata is produced, each object signal may be linked with a screen. However, there is no guarantee that a size of a video screen viewed by a user is always the same as a size of a screen referred to by a producer in case of producing the metadata. Therefore, when a random object is linked with a video screen, screen size information is also stored together. And, a screen mismatch problem occurring between the producer and the user can be solved through Screen Size Remapping 30412.

Local screen size information refers to size information of a screen viewed by a user. Therefore, when the corresponding information is received, object metadata informations linked with the video screen (e.g., azimuth and elevation information of an object in general) is remapped according to a size of a screen viewed by the user, and thus producer's intention may be applied to screens in various sizes.

In the second part (interaction part) 3042, interaction data information and zoom area information are used. The interaction data information includes informations that a user wants to directly change the features of a currently played audio scene, and typically includes position change information and size change information of an audio signal. The position change information may be expressed as variations of azimuth and elevation, and the size information may be expressed as a variation of a gain. If the corresponding informations are inputted, 'Gain'& Position interactive processing' 30421 changes position information and size information of the object metadata of the first part (configuration part) 3041 by a variation inputted to the interaction data information. Gain information and position information are applicable only to the object signal. In addition, the zoom area information is the information used when a user wants to enlarge a portion of a screen while watching a random content, and if the corresponding information is inputted, 'Zoom area & object remapping' 30422 re-maps the position information of the object signal linked with the video screen to fit a zoom area.

The third part (tracking part) 3043 mainly uses scene displacement information and user position information 212. The scene displacement information refers to head rotation information and is generally referred to as rotation information (yaw, pitch, and roll). If a user rotates a head in an environment in which a tracking mode is operating, the rotation information (yaw, pitch and roll) is inputted to 'adjust audio scene direction information' 30431, thereby changing the position information of the audio scene by an amount of the rotation. The user position information 212 refers to position change information of the user, and may be represented by azimuth, elevation, and distance. Thus, when the user moves the position, 'adjust audio scene metadata information' 30432 reflects the audio scene by the changed position. For example, if an user moves toward a front side in a situation where an audio scene composed of an object is being played, a gain of the object located on the front side is increased and a gain of the object located on the rear side is decreased. Additionally, when an audio scene is played in a speaker environment, the changed position of the user may be reflected in 'adjust speaker layout information' 30413. The playback environment information changed by the user is then forwarded to the renderer 202 of FIG. 3.

FIGS. 5 to 12 illustrate a modeling method in the audio play apparatus according to an embodiment of the present invention.

First of all, with reference to FIGS. 5 to 8, an operation of the first modeling unit (environment modeling) 2052 will be described in detail. When the 3D audio decoder of the present invention is extended to be usable in a 6DoF environment and compared with the existing 3DoF environment, the biggest difference exhibited may be seen as a part of modeling a BRIR. In the existing 3DoF-based 3D audio decoder, when a sound source is played with a headphone, a previously produced BRIR is directly applied to the sound source, but in a 6DoF environment, a BRIR according to a user position should be applied to a sound source in a manner of being modeled each time to play a realistic sound source whenever a user position is changed.

For example, if audio signal rendering is performed on the basis of the 22.2-channel environment using the aforementioned 'MPEG-H 3D Audio decoder' 201, a BRIR for the 22 channel is previously retained and then directly usable each time it is necessary. Yet, in a 6DoF environment, a user moves in a random space and a BRIR of the 22 channel for a moved position is newly modeled or a BRIR previously measured at the corresponding position is secured and then used. Therefore, when the first modeling unit (environment modeling) 2052 operates, a BRIR should be modeled by minimizing the amount of computation.

Figure 5:
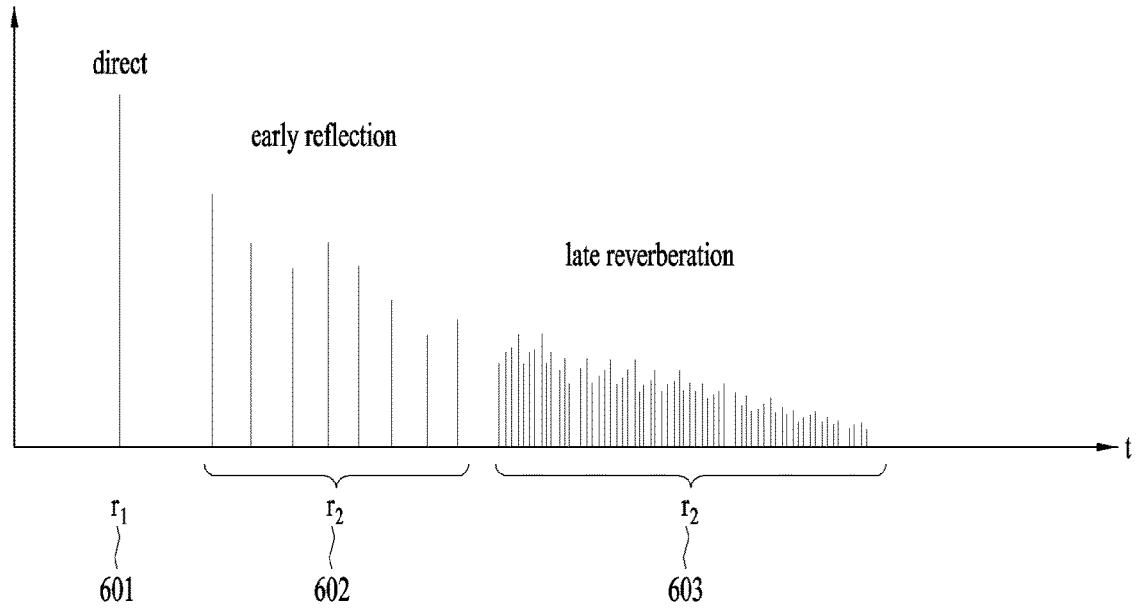
FIGS. 5 to 12 illustrate a rendering data modeling method in the audio play according to an embodiment of the present invention.

Generally, an RIR has three kinds of response characteristics as shown in FIG. 5. The response corresponding to an R1 601 first is a direct sound and a sound source is delivered directly to a user without spatial reflection. An r2 602 is an early reflection and a response that a sound source is reflected once or twice in an enclosed space and then delivered to a user. In general, the early reflection is affected by the geometric features of the space, thereby changing the spatial features of the sound source, and negatively affecting the spreading sense of hearing. Finally, an r3 603 is a late reverberation and a response that is delivered to a user after a sound source has been totally reflected back to the floor, ceiling, wall, etc. of a space, and the corresponding response changes the response by the sound absorption or reflective material of the space and affects the reverberation of hearing. In general, in case of the direct sound 601 and the early reflection 602, the response characteristics tend to vary depending on the position and direction in which the sound source is generated, but in the case of the late reverberation 603, since the characteristics of the space itself are modeled, the characteristics of the modeled response do not change even though a user changes a position. Accordingly, the present invention proposes to model the early reflection 602 and the late reverberation 603 independently from each other when the first modeling unit (environment modeling) 2052 operates. This is described as follows.

User position information, sound source position information, and room characterization information may be used as inputs to model the early reflection 602 of which response changes variably according to a user position. The user position information may be expressed as azimuth, elevation, and distance as described above, and may be expressed as (θ, φ, γ) when expressed in units configuring a three-dimensional spherical coordinate system. In addition, it may be expressed as (x, y, z) in unit of a three-dimensional Cartesian coordinate system. Moreover, it is well known that the two coordinate systems can be converted to each other using an axis-transformation formula.

Generally, a sound source is played through a speaker, so that position information of the sound source may be represented with reference to speaker layout information. If a used speaker format is a standard speaker format, the speaker format can be used with reference to the standard speaker layout information, and if a speaker format of user definition is used, a user may directly input position information of the speaker to use. Since azimuth, elevation and distance information is received as the speaker layout information, the position information of the speaker may be expressed in unit of a spherical coordinate system or a Cartesian coordinate system like user position information.

Space information (environment information) may mainly include space size information and room characterization information, and the space size information may be expressed as [L, W, H] (length, height, width, unit (m)), assuming that the space is a rectangular parallelepiped. The room characterization information may be represented by a material characteristic of each face forming a space, which may be represented by an absorption coefficient (α) or a reverberation time with respect to a space.

Figure 6:
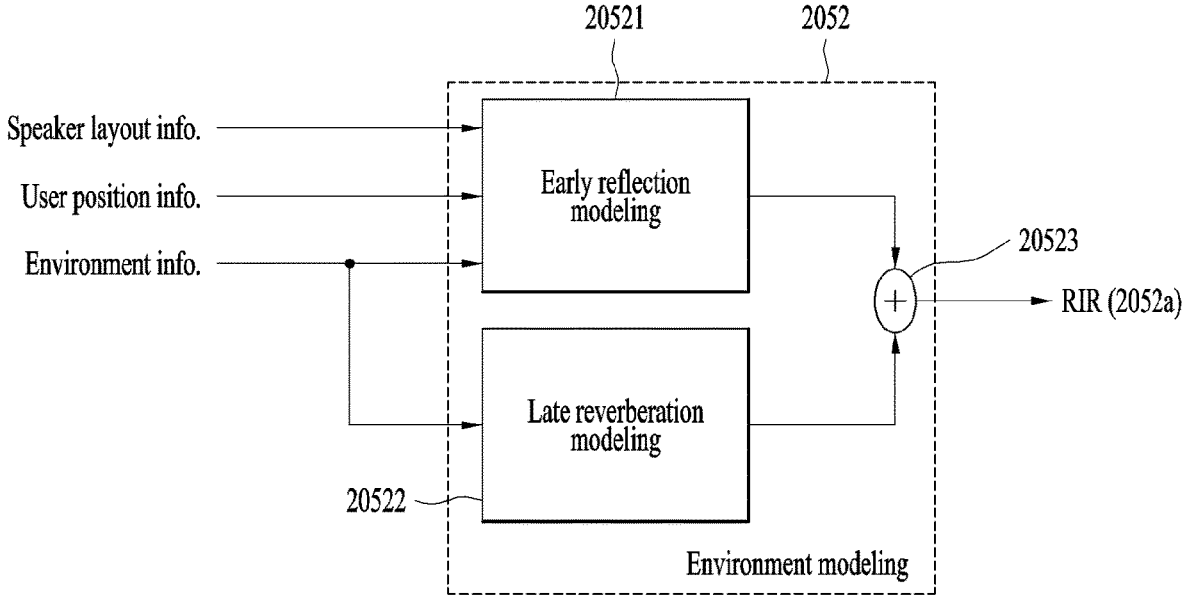

FIG. 6 shows the first modeling unit 2052 of the present invention. The first modeling unit 2052 of the present invention includes an early reflection modeling unit 20521 for modeling the early reflection 602, a late reverberation modeling unit 20522 for modeling the late reverberation 603, and an adder 20523 for adding the modeling result and outputting a final RIR data 2052*a*.

In order to model an RIR room response, in addition to user position information, a receiving end receives speaker layout information and room characterization information (environment info.) associated with a playback environment together to model the early reflection 602 and the late reverberation 603 and then generates a final RIR room response by assuming them. Then, if a position of a user is changed in a 6DoF environment, the receiving end newly models only an early reflection response to the changed user position through the early reflection modeling unit 20521, thereby updating the entire room response.

Figure 7:
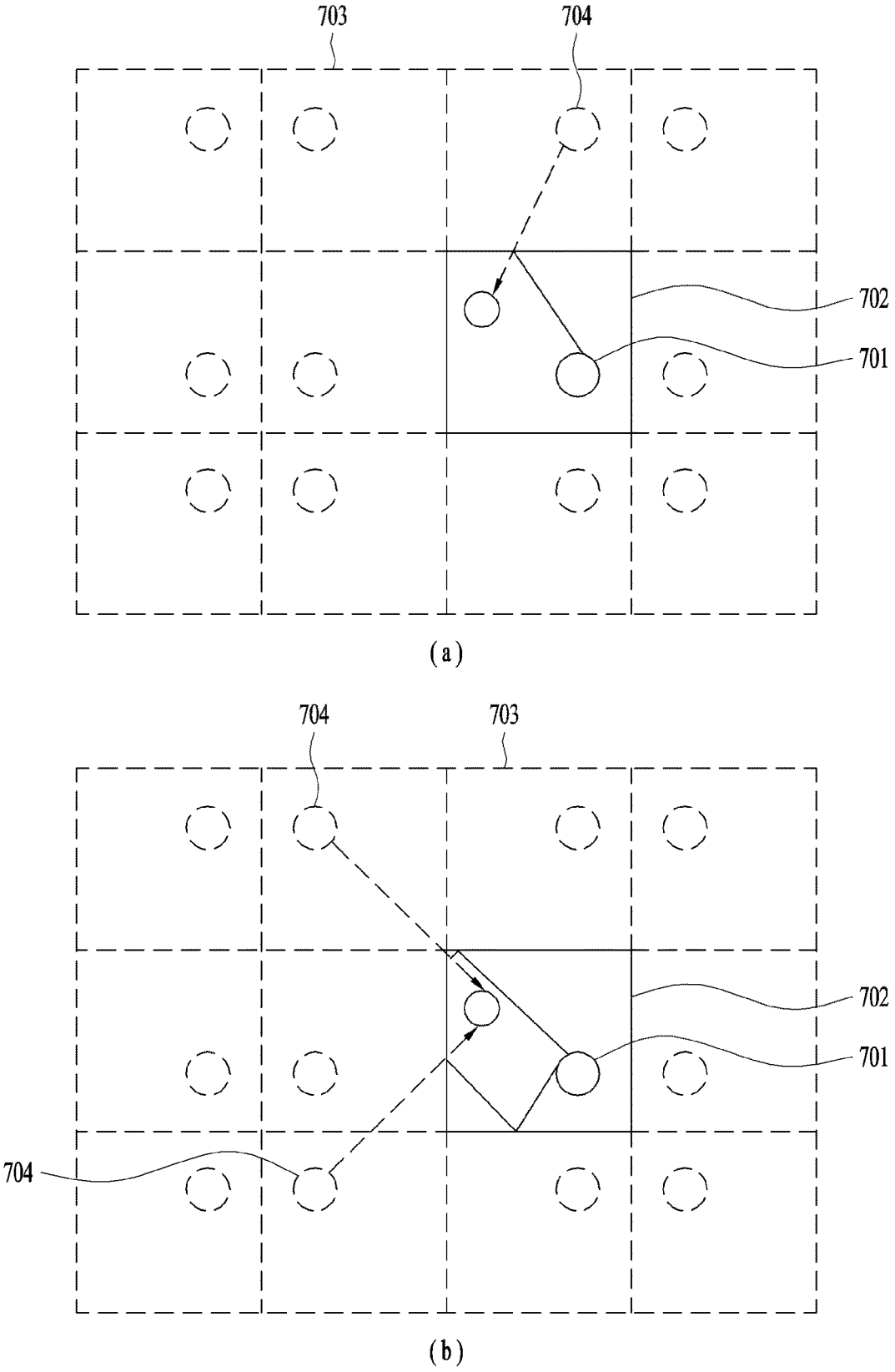

FIG. 7 is a diagram to describe the early reflection modeling 20521. The early reflection modeling 20521 is a process of modeling only the early reflection 602 of the room response. A response may be set to be modeled only to a secondary or tertiary reflection by using 'image source method', 'ray-tracing method' or the like based on user position information, each speaker layout information, and space information (environment information ([L, W, H], α).

FIG. 7 (*a*) shows a case in which a sound source 701 generated in a random closed space is transmitted by being reflected once, and FIG. 7 (*b*) shows a case in which the sound source 701 is transmitted by being reflected twice. In FIG. 7 (*a*) and FIG. 7 (*b*), an area denoted by a solid line is a real space 702, and a dotted area is a virtual area 703 that symmetrically extends the actual space. As shown in FIG. 7 (*a*) and FIG. 7 (*b*), if a space is extended to the virtual area 703 according to a path in which the sound source is reflected in the real space 702, it can be assumed that it is a direct sound of a sound source 704 generated in the symmetrical virtual area 703. Therefore, a room response of a random space may be modeled by using information such as material properties (sound absorption coefficients) of a floor, a ceiling and a wall, which reduce a size of a sound source due to a space size, a distance between a sound source and a user position in a virtual space, and reflection.

Figure 8:
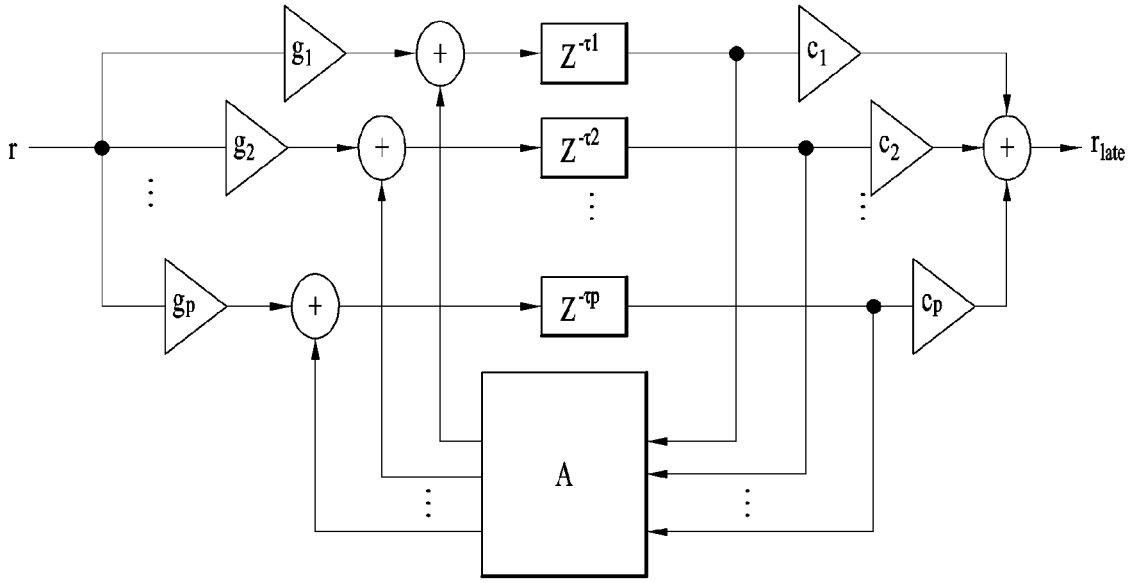

FIG. 8 is a diagram to describe the late reverberation modeling 20522. The late reverberation modeling 20522 is the process of modeling only the late reverberation 603 of the room response. With reference to a reverberation time of space information, modeling is possible with a Feedback Delay Network-based (FDN-based) algorithm. Namely, the FDN consists of several comb filters. Parameters (g $[g_1, g_2, \ldots, g_P]$, c=$[c_1, c_2, \ldots, c_P]$, τ=$[\tau_1, \tau_2, \ldots, \tau_P]$, P) shown in FIG. 8 should be configured in a manner that user's intended property is well-reflected in a modeled response. For example, the parameter P means the number of comb filters. In general, the more the number of filters gets, the better the performance becomes. Yet, as the overall computation amount is also increased, it should be properly configured to fit a given environment. The parameter τ represents the total delay of the comb filter and has a relationship of $\tau=\tau_1+\tau_2+\ldots+\tau_P$. Here, $\tau_1, \tau_2, \ldots, \tau_P$ are set to values that are not in multiples of each other. For example, if P=3 and τ=0.1 ms, $\tau_1$=0.037 ms, $\tau_2$=0.0 5 ms, and $\tau_3$=0.013 ms can be set. Parameters g=$[g_1, g_2, \ldots, g_P]$ and c=$[c_1, c_2, \ldots, c_P]$ are set to values smaller than 1. Since optimal parameter values for the response characteristic intended by a user are not numerically calculated when modeling the late reverberation with the FDN structure, a user arbitrarily sets them based on the given information ($RT_{60}$, room characterization, space size, etc.).

Figure 9:
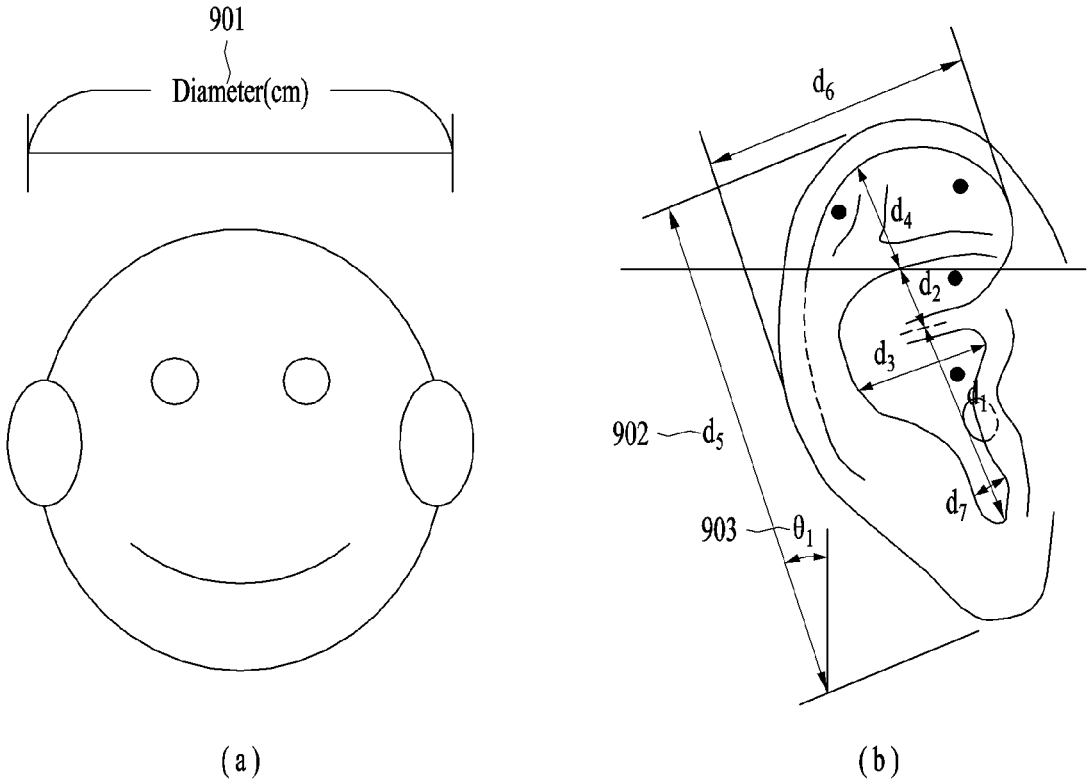

Next, with reference to FIGS. 9 to 11, the operation of the second modeling unit (HRIR modeling) 2051 will be described in detail. FIG. 9 is a diagram to describe a process of modeling user's head and ear features applied to the second modeling unit 2051. In general, head shape modeling uses a user's head size (diameter) 901 and the feature of the user's ear as shown in FIG. 9 (*a*) and FIG. 9 (*b*). As shown in FIG. 9 (*b*), information used to model the features of the user's ear may be configured by including length values 902 (d1~d7) configuring the ear and an angle value 903 configuring the appearance of the ear. If the HRIR modeling by the second modeling unit 2051 is completed, the $HRIR_L$ 2051*a* and the $HRIR_R$ 2051*b* described in FIG. 3, which correspond to left and right ear responses, respectively, are outputted. In this regard, since each user has different ear features, in order to maximize the effect of the three-dimensional audio through the 3D audio decoder, a user acquires user's HRIR in advance and then applies it to a content. However, since much time and cost are required for this process, HRIR modeling by the second modeling unit 2051 or HRIR individualization may be used to compensate problems that may be caused when using the existing universalized HRIR. Hereinafter, HRIR modeling and individualization methods will be described in detail with reference to FIG. 10 and FIG. 11.

Figure 10:
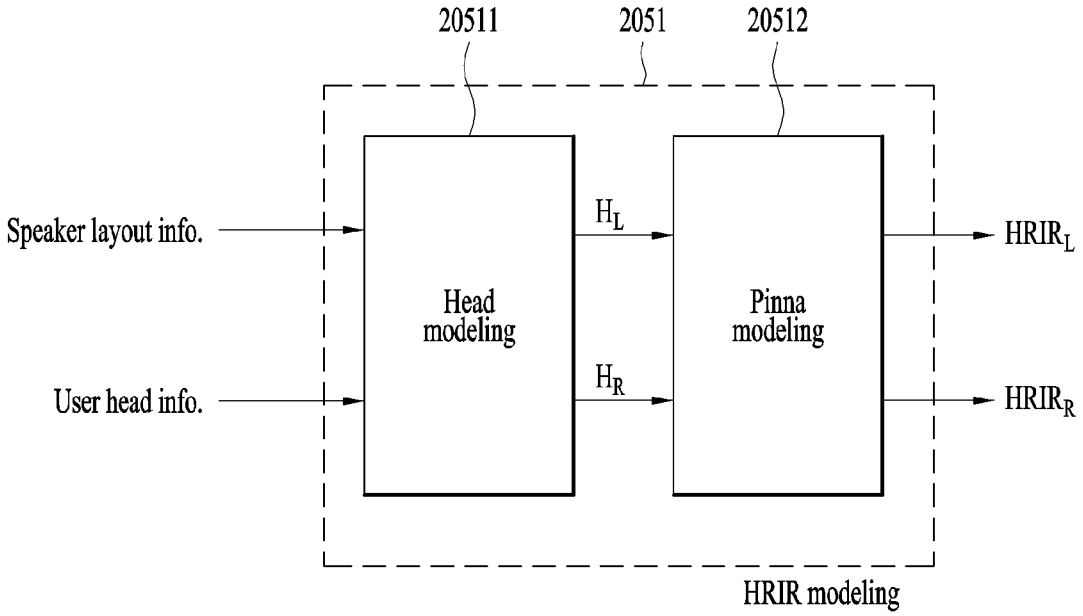

FIG. 10 shows a basic block diagram of the HRIR modeling by the second modeling unit 2051. Speaker layout information and user head information may be used as inputs. In this regard, the speaker layout information is also utilized as sound source position information. In addition, a standard speaker format can be used with reference to standard speaker layout information, and for a speaker environment arranged by a user definition, a user can directly input speaker layout information. The speaker layout information may be expressed as (θ, φ, γ) in spherical coordinate system units or (x, y, z) in Cartesian coordinate system units and axes of the two coordinate systems can be converted to each other using an axis-conversion formula. The user head information includes head size information, which can be manually inputted by a user, or can be automatically inputted by mechanically measuring a user head size in connection with a headphone or a sensor.

The second modeling unit 2051 of FIG. 10 includes a head modeling unit 20511 and a pinna modeling unit 20512. The head modeling unit 20511 may use the sound source position information and the user head size information to indicate the transfer function ($H_L$, $H_R$) for a head shadow in which ITD and ILD used for a person to recognize a position of a sound source are reflected, respectively. The pinna modeling unit 20512 is a process of modeling a response reflecting the influence by a user ear's pinna, and can model the response most suitable for a user by reflecting the combination of various predetermined constant values in the modeling process.

Figure 11:
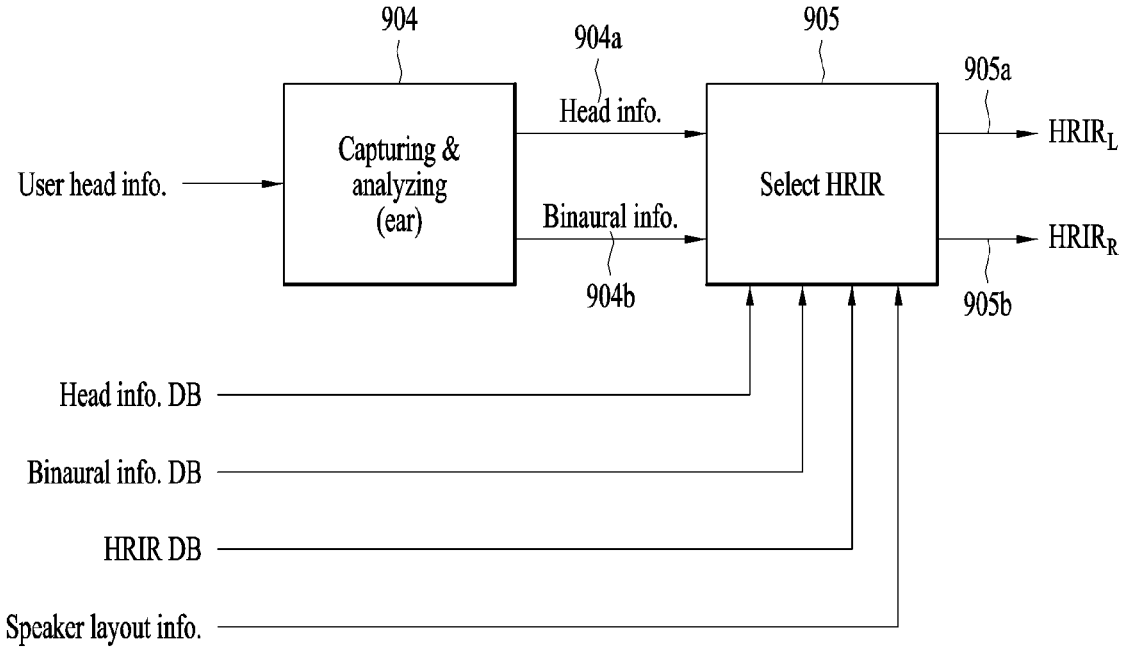

FIG. 11 illustrates the HRIR individualization process. In FIG. 11, a bold solid line refers to a database (DB) that has been obtained and held in advance. As inputs, sound source position information (speaker layout info.), head size information (user head info.) on various subjects, binaural information DB (binaural info DB) including binaural feature information, HRIR DB and user's head size and binaural feature information DB (head info DB) may be used. The binaural feature information means size and shape information of left and right ears, and the user may manually input the corresponding information or the corresponding information may be automatically inputted in a manner of mechanically measuring and analyzing shapes of ears by capturing the ears using a camera or an imaging device. If the shape of the ear is measured using a camera or an imaging device, lengths of various portions of the ear can be measured, as shown in FIG. 9 (*b*) described above, to analyze features of the ear. A capture & analyzing unit 904 of FIG. 11 captures and analyzes user's ears and outputs head and binaural informations 904*a* and 904*b*. Thereafter, the head and binaural informations 904*a* and 904*b* are inputted to an HRIR selection unit (Select HRIR) 905 and then compared with binaural feature information DBs of various subjects. If a random subject having the most similar feature within the DB is selected, HRIR of the corresponding subject is regarded as listener's HRIR 905*a*, 905*b* and used.

Figure 12:
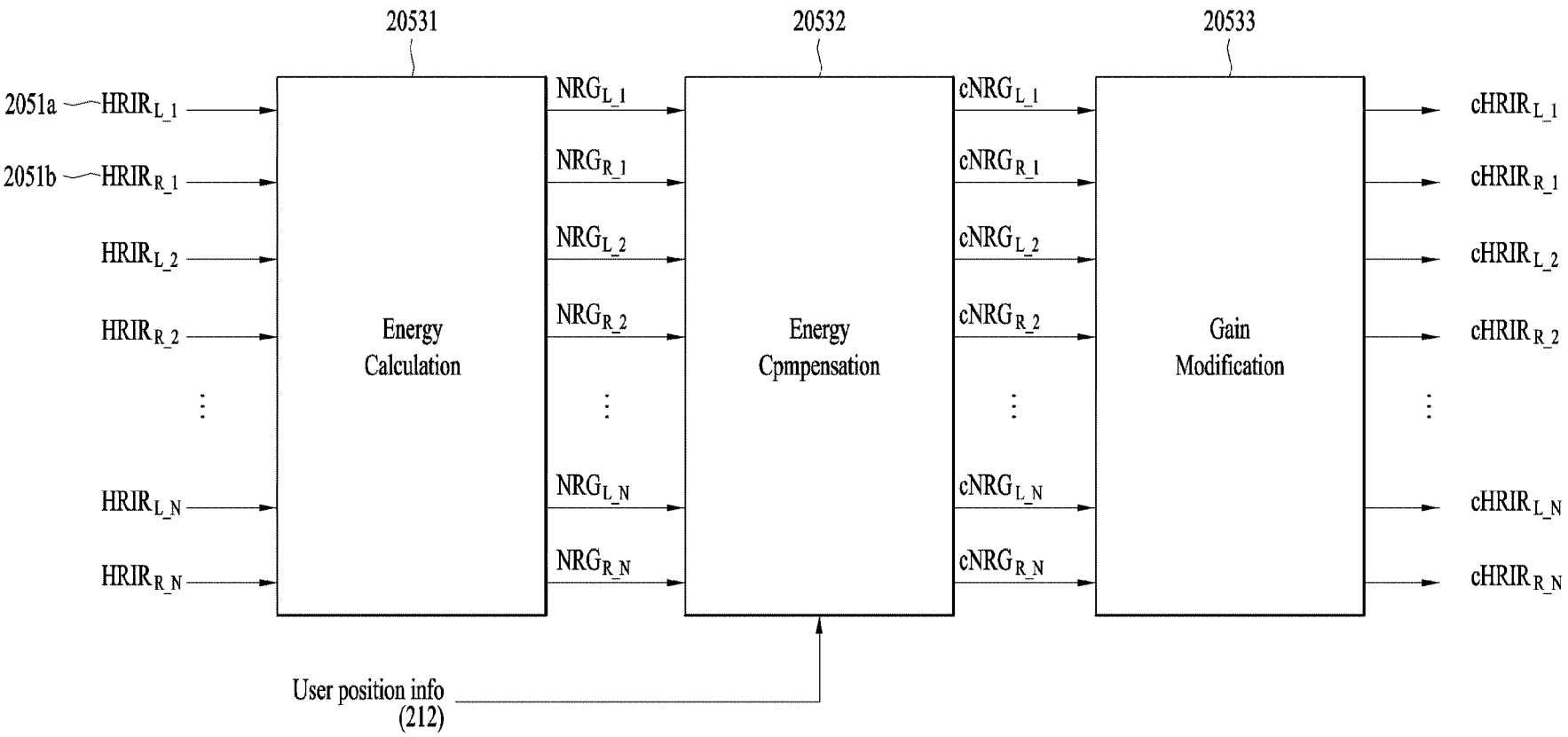

FIG. 12 is a diagram to describe a detailed operation of the distance compensation unit 2053. The distance compensation unit 2053 includes an energy calculation unit 20531, an energy compensation unit 20532, and a gain modification unit 20533.

First of all, the energy calculation unit 20531 receives inputs of the HRIRs 2051*a* and 2051*b* ($HRIR_{L_1}$, $HRIR_{R_1}$, . . . , $HRIR_{L_N}$, $HRIR_{R_N}$) modeled by the aforementioned second modeling unit 2051, and calculates energies $NRG_{L_1}$, $NRG_{R_1}$, . . . , $NRG_{L_N}$, $NRG_{R_N}$ of the HRIRs, respectively.

The energy compensation unit 20532 receives inputs of the calculated energies $NRG_{L_n}$ and $NRG_{R_n}$ and the aforementioned user position information 212, and compensates the calculated energies $NRG_{L_n}$ and $NRG_{R_n}$ by referring to the changed position of the user. For example, if the user moves to a front side, the energy of the HRIRs measured on the front side is greatly adjusted in proportion to the moving distance, but the energy of the HRIRs measured on the back side is adjusted to be small in proportion to the moving distance. An initial position of the user is assumed to be at the very center that corresponds to the same distance from all speakers located in the horizontal plane, and the position information of the user and the speaker may be represented with reference to azimuth, elevation, and distance. Thus, when the user changes a position, a relative distance variation for each speaker can be calculated. The energy values $cNRG_{L_1}$, $cNRG_{R_1}$, . . . , $cNRG_{L_N}$, $cNRG_{R_N}$ of the HRIR corrected by the energy compensation unit 20532 are inputted to the gain modification unit 20533, and the gains of all HRIRs are modified to match the changed distance so as to output the corrected HRIR $cHRIR_{L_1}$, $cHRIR_{R_1}$, . . . , $cHRIR_{L_N}$, $cHRIR_{R_N}$. Since the physical quantity for the square of the gain corresponds to energy, it is possible to compensate for the gain of the HRIR according to the change of the user position by taking the root of the corrected energies and multiplying the HRIR corresponding to each energy (i.e., the HRIR compensated by the energy compensation unit 20532) by the root.

FIGS. 13 to 22 are diagrams to describe a syntax structure utilized in an audio play method and apparatus according to an embodiment of the present invention. The present invention is described on the basis of a 6DoF MPEG-H 3D Audio decoder according to use examples of two rendering types (e.g., a speaker environment and a headphone environment) of a 3D audio decoder for 6DoF.

(1) [Use Example 1] 6DoF 3D Audio in Speaker Environment

In case of intending to play a content by selecting the rendering type 206*a* as a speaker in FIG. 3, an audio scene should be rendered by referring to the user position information 212 in real time. According to an embodiment of the present invention, the user position information 212 is the information newly inputted to the metadata processor (metadata and interface processing) 204 in order to use the existing MPEG-H 3D Audio encoder in a 6DoF environment. The user position information 212 may change the speaker layout information (local speaker layout) 206*f*, the interaction data (interaction data information) 207*b*, and the zoom area information 207*c*. The speaker layout information (local speaker layout) 206*f* contains the position and gain information of each speaker.

The zoom area information 207*c* is the information used when a user enlarges a portion of a screen currently viewed by the user. And, a position of an audio object associated with the screen is also changed while enlarging a portion of the currently viewed screen. Thus, when the user moves closer to the screen, an object gain may be adjusted in proportion to a distance that the user moves. In a situation that the user controls the interaction data (interaction data information) 207*b*, the gain can be changed according to a position of the user. For example, although a random object gain configuring an audio scene is adjusted small, the object gain is greatly adjusted in proportion to a relative changed distance between the user and the object when the user approaches the position at which the corresponding object is located.

(2) [Use Example 2] 6DoF 3D Audio in Headphone Environment

In the exiting MPEG-H 3D audio encoder, when a random audio content is played through a headphone, a previously acquired BRIR is filtered to reproduce a stereoscopic 3D audio. However, this result is valid only when a user's position is fixed, but the reality is greatly reduced if the user changes a position. Accordingly, in the present invention, a BRIR is newly modeled with reference to a changing user position to provide a more realistic audio content in a 6DoF environment. When the rendering type 206 is selected as a headphone in FIG. 3 to play a content like the 6DoF environment, a BRIR is modeled by referring to the user position information 212 in real time, and an audio scene is rendered by applying the modeled BRIR to an audio content. The BRIR may be modeled through the first modeling unit (environment modeling) 2052 and the second modeling unit (HRIR modeling) 2051.

Hereinafter, a syntax of adding the user position information 212 to an "MPEG-H 3D Audio decoder" is described in order to play a VR audio content in a 6DoD environment. In particular, a part denoted by a dotted line in the syntax below is shown to highlight an added or modified part to support 6DoF in accordance with an embodiment of the present invention.

FIG. 13 shows the syntax of "mpegh3daLocalSetupInformation( )" of "MPEG-H 3D Audio Decoder".

The is6DoFMode field 1301 indicates whether or not to use in a 6DoF manner. That is, if the field is '0', it may be defined to mean the existing manner (3DoF). If the field is '1', it may be defined to mean the 6DOF manner. The is6DoFMode field 1301 is an indicator flag information indicating 6DoF, and is further provided with various 6DoF applied information fields described later, depending on whether the information exists.

First of all, if the above-mentioned 6DoF indicator flag information (is6DoFMode) 1301 indicates '1' [1301*a*], information of an up_az field 1302, an up_el field 1303 and an up-dist field 1304 may be additionally provided.

In the up_az field 1302, user position information is given as an angle value in terms of azimuth. For example, the angle value may be defined as given between "Azimuth=−180°~Azimuth=180°". In the up_el field 1303, user position information is given as an angular value in terms of elevation. For example, the angle value may be defined as given between "elevation=−90°~elevation=90°". In the up_dist field 1304, user position information is given in terms of distance. For example, the length value may be defined as given between "Radius=0.5 m~Radius=16 m".

Also, a bsRenderingType field 1305 defines the rendering type. Namely, as a rendering type, as described above, it is able to define to indicate one of two use examples of a rendering in in a speaker environment ("Louderspeaker Rendering" 1305*a*) and a rendering in a headphone environment ("Binaural Rendering" 1305*b*).

In addition, a bsNumWIREoutputs field 1306 defines the number of "WIREoutput", and may define to be determined between 0~65535 for example. A WireID field 1307 includes identification information (ID) on the "WIRE output". Moreover, a hasLocalScreenSizeInformation field 1308 is the flag information that defines whether screen size information (local screen size) is usable. If the flag information 1308 indicates that the screen size information (local screen size) is usable, a syntax of "LocalScreenSizeInformation( )" 1308*a* is additionally configured.

In FIG. 14, position information and gain information of a speaker in a playback environment of 6 DoF are illustrated as a syntax of "Louderspeaker rendering ( )" 1305*a* when the rendering type (bsRenderingType) 1305 described above indicates the rendering in the speaker environment ("Louderspeaker rendering").

First of all, a bsNumLoudspeakers field 1401 defines the number of loudspeakers in the playback environment. In addition, a hasLoudspeakerDistance field 1402 is a flag information indicating whether a distance of the speaker (loudspeaker) is defined. In addition, a hasLoudspeakerCalibrationGain field 1403 is a flag information indicating whether a speaker Calibration Gain has been defined. In addition, a useTrackingMode field 1404 is a flag information indicating whether or not to process a scene displacement value transmitted over a "mpeg3daSceneDisplacement Data( )" interface. In this regard, all the fields 1402, 1403, and 1404 are informations given to a case 1301*b* that the above-mentioned 6DoF indicator flag information (Is6DoFMode) 1301 has a value of '0'.

In addition, a hasKnownPosition field 1405 is the flag information indicating whether the signaling for a position of a speaker is performed in a bitstream.

If all of the above-mentioned 6DoF indicator flag information (is6DoFMode) 1301 and the hasKnownPosition field 1405 indicate '1' [1301C], informations of a loudspeakerAzimmuth field 1406 and a loudspeakerelevation field 1407 are further defined. The loudspeakerAzimmuth field 1406 defines an orientation angle of the speaker. For example, a value between −180° and 180° may be defined as having 1° intervals. For example, it may be defined as "Azimuth=(loudspeakerAzimuth−256); Azimuth=min (max (Azimuth,−180), 180)". In addition, the loudspeakerElevation field 1407 defines the elevation angle of the speaker. For example, a value between −90° and 90° may be defined as having 1° intervals. For example, it may be defined as "Elevation=(loudspeakerElevation−128); Elevation=min (max (Elevation, −90), 90)".

In addition, if all of the above-mentioned 6DoF indicator flag information (is6DoFMode) 1301 and the hasLoudspeakerDistance field 1402 indicate '1' [1301*d*], information of a loudspeakerDistance field 1408 is further defined. The loudspeakerDistance 1408 defines a distance to a reference point (i.e., this may be considered as a user position) located at the center of the speaker in unit of centimeters. For example, it may have a value between 1 and 1023.

In addition, if all of the above-mentioned 6DoF indicator flag information (is6DoFMode) 1301 and the hasLoudspeakerCalibrationGain field 1403 indicate '1' [1301E], a loudspeakerCalibrationGain field 1409 information is further defined next. The loudspeakerCalibrationGain 1409 defines a speaker calibration gain in dB unit. For example, a value between 0 and 127 corresponding to a dB value between "Gain=−32 dB~Gain=31.5 dB" may be defined in 0.5 dB intervals. In other words, it can be defined as "Gain [dB]=0.5×(loudspeakerGain−64".

In addition, an externalDistanceCompensation field 1410 is a flag information indicating whether to apply a compensation of a speaker (Loudspeaker) to a decoder output signal. If the corresponding flag 1410 is '1', the signaling for the loudspeakerDistance field 1402 and the loudspeakerCalibrationGain field 1403 is not applied to the decoder.

FIG. 15 illustrates a syntax for receiving information related to user interaction. In order to enable an user interaction even in a 6DoF environment, user's position change detection information is added. If the user's position change is detected in the 6DoF environment, interaction informations are readjusted based on the changed position.

First of all, if the above-described 6DoF indicator flag information (is6DoFMode) 1301 indicates '1' [1301*f*], information of an isUserPosChange field 1501 may be further provided next. The isUserPosChange field 1501 indicates whether the user's position is changed. That is, if the field 1501 is '0', it may be defined to mean that the user's positon is not changed. If the field 1501 is '1', it may be defined to mean that the user's position has been changed.

In this regard, an ei_InteractionSignatureDataLength field in FIG. 15 is a value defining a length of an interaction signature in byte unit. Also, an ei_InteractionSignatureDataType field defines a type of the interaction signature. In addition, an ei_InteractionSignatureData field includes a signature that defines a creator of interaction data. In addition, a hasLocalZoomAreaSize field is a flag information that defines whether information on a local zoom size is usable.

For reference, a feature of an audio object that is associated with a video screen may be changed in "mpegh3daElementInteraction( )" syntax, and a feature of an object that configures an audio scene interacting with a user may be changed in "ElementInteractionData( )" syntax. If a user's position change is detected in the "mpegh3daElementInteraction( )" syntax, it is possible to re-adjust the information of the object on the basis of the user's position by referring to the user's position information received in the "mpegh3daLocalSetupInformation( )" syntax, so that no separate syntax is additionally needed. Therefore, since it is sufficient for "LocalZoomAreaSize( )" and "ElementInteractionData( )" syntaxes to utilize the existing "MPEG-H 3D Audio" syntax, a detailed description thereof will be omitted.

FIG. 16 illustrates audio output information through a headphone in a 6DoF playback environment as a syntax of "BinauralRendering( )" 1305*b* if the rendering type (bsRenderingType) 1305 described above indicates a rendering in a headphone environment.

First of all, if the above-described 6DoF indicator flag information (Is6DoFMode) 1301 indicates '1' [1301*g*]), next informations of a bsNumLoudspeakers field 1601, a loudspeakerAzimuth field 1602, a loudspeakerElevation field 160), a loudspeakerDistance field 1604, a loudspeakerCalibrationGain field 1605, and an externalDistanceCompensation field 1606 may be further provided. In this regard, it is possible to define the meanings of the fields 1601 to 1606 as the same meanings of the corresponding fields of FIG. 14 described above.

Moreover, if the aforementioned 6DoF indicator flag information (Is6DoFMode) 1301 indicates '1' [1301*g*], a syntax of "RIRGeneration( )" 1607 for generating RIR data and a syntax "RIRGeneration( )" 1608 for generating HRIR data are additionally required. With reference to FIGS. 17 to 23, the added syntaxes of the "RIRGeneration( )" 1607 and the "RIRGeneration( )" 1608 will be described in detail.

FIGS. 17 to 20 illustrate syntaxes required for generating RIR. First, FIG. 17 shows the syntax of "RIRGeneration( )" 1607 in a manner of representing RIR. A bsRIRDataFormatID 1701 indicates the representation type of the RIR. That is, if a previously made RIR is used, a syntax of "RIRFIRData( )" 1702 is executed. On the other hand, when the RIR is obtained through a modelling method, a syntax of an "RIRModeling( )" 1703 is executed.

FIG. 18 shows the syntax of the "RIRFIRData( )" 1702. In this regard, a bsNumRIRCoefs field 1801 refers to a length of an RIR filter. A bsNumLengthPosIdx field 1802 refers to an index for a horizontal position in a space. For example, up to 0~1023 m may be defined in 1 m intervals. A bsNumWidthPosIdx field 1803 refers to an index for a vertical position in the space. For example, up to 0~1023 m may be defined in 1 m intervals. The bsNumLengthPosIdx field 1802 and the bsNumWidthPosIdx field 1803 defined in the RIRFIRData( )" 1702 refer to position information in a random space. The RIR is obtained at a position where the corresponding index is defined. Therefore, a position of RIR measured at a most adjacent position with reference to user's position information is received and RIR data about the corresponding position is received.

FIG. 19 shows a syntax of the "RIRModeling( )" 1703. If it is intended to obtain RIR through a modeling method, the RIR is modeled by receiving information on a space and parameters necessary for modeling.

With reference to FIG. 19, each of the fields in the syntax of "RIRModeling( )" 1703 is described as follows. A bsNumRIRCoefs field refers to a length of an RIR filter. A RoomLength field is length information of a space and is given as a length (meter) value. A RoomWidth field is width information of the space and is given as a length (meter) value. A RoomHeight field is height information of the space and is given as a length (meter) value. An AbsorpCoeffCeil field means a ceiling sound absorption rate and is represented by a sound absorption coefficient. For example, the sound absorption coefficient is given as a value between 0 and 1. An AbsorpCoeffFloor field means a floor sound absorption rate and is represented as a sound absorption coefficient. For example, the sound absorption coefficient is given as a value between 0 and 1. An AbsorpWallFront field refers to a front wall sound absorption rate and is represented as a sound absorption coefficient. For example, the sound absorption coefficient is given as a value between 0 and 1. An AbsorpWallBack field refers to a back wall sound absorption rate and is represented as a sound absorption coefficient. For example, the sound absorption coefficient is given as a value between 0 and 1. An AbsorpWallLeft field indicates a left-wall sound absorption rate and is represented as a sound absorption coefficient. For example, the sound absorption coefficient is given as a value between 0 and 1. An AbsorpWallRight field indicates a sound absorption rate of a right wall and is represented as a sound absorption coefficient. For example, the sound absorption coefficient is given as a value between 0 and 1. An nTapFilter field indicates the number of comb filters used, and as a comb filter coefficient, a dly field has a filter delay value, a gain_b field indicates a pre-gain value, a gain_c field indicates a post gain value, an A field indicates a feedback matrix value, and a b_af field indicates a sound-absorbent filter coefficient value. In addition, a dly_direct field indicates a delay value applied to a direct signal, and a tf_b field indicates a tone correction filter coefficient value.

Also, in a syntax of "RIRModeling( )" 1703, a syntax of "ERModeling( )" 1910 that is applied for an early reflection modeling is included. FIG. 20 illustrates a ModelingMethod field 2001 included in the syntax of the "ERModeling( )" 1910. The modelingMethod field 2001 refers to a method used for an Impulse Response (IR) modelling. For example, in case of '0', it may be defined to use an 'image source method'. Otherwise, it may be defined to use another method.

FIGS. 21 to 23 intend to described a syntax of "HRIRGeneration( )" 1608 in detail. First, FIG. 21 shows the syntax of "HRIRGeneration( )" 1608 in a manner of representing HRIR.

A bsHRIRDataFormatID field 2101 represents the expression type of the HRIR. That is, using a previously made HRIR, a syntax of "HRIRFIRData( )" 2102 is executed. On the other hand, when the HRIR is obtained through a modeling method, a syntax of "HRIRModeling( )" 2103 is executed.

FIG. 22 shows a syntax of the "HRIRFIRData( )" 2102. A bsNumHRIRCoefs field 2201 refers to the length of an HRIR filter. A bsFirHRIRCoefLeft field 2202 indicates the coefficient value of the HRIR filter of the left ear. A bsFirHRIRCoefRight 2203 indicates the coefficient value of the HRIR filter of the right ear.

FIG. 23 shows a syntax of the "HRIRModeling( )" 2103. A bsNumHRIRCoefs field 2301 refers to the length of the HRIR filter. A HeadRadius field 2302 refers to the radius of the head and is expressed in unit of length (cm). A PinnaModelIdx field 2303 means an index for a table in which the coefficients used in modeling a pinna model are defined.

MODE FOR INVENTION

The present invention proposes an audio PLAY apparatus and method for implementing A VR audio in a 6DoF environment. A bitstream transmitted from a transmitting end is inputted to an audio recorder to output a decoded audio signal. The outputted decoded audio signal is inputted to a binaural renderer and filtered in a Binaural Room Impulse Response (BRIR) to output left and right channel signals ($OUT_L$, $OUT_R$). The BRIR is calculated by synthesizing a room response and binaural Head-Related Impulse Response (HRIR) (Response of converting HRTF on a time axis). And, the room response may be efficiently generated by being provided with user position information & user direction information in a space. The HRIR may be possibly extracted from HRIR DB by referring to the user direction information. If the left and right channel signals $OUT_L$ and $OUT_R$ outputted through a binaural rendering are listened to using headphones or earphones, a listener can feel the same effect as if a sound image is located at a random position in a space.

INDUSTRIAL APPLICABILITY

The above-described present invention can be implemented in a program recorded medium as computer-readable codes. The computer-readable media may include all kinds of recording devices in which data readable by a computer system are stored. The computer-readable media may include ROM, RAM, CD-ROM, magnetic tapes, floppy discs, optical data storage devices, and the like for example and also include carrier-wave type implementations (e.g., transmission via Internet). Further, the computer may also include, in whole or in some configurations, an audio decoder (MPEG-H 3D Audio Core Decoder) 201, a renderer 202, a binaural renderer 203, a metadata processor (metadata and interface data processor) 204, and a rendering data modeling unit 205. Therefore, this description is intended to be illustrative, and not to limit the scope of the claims. Thus, it is intended that the present invention covers the modifications and variations of this invention provided they come within the scope of the appended claims and their equivalents.

What is claimed is:

1. A method of playing an audio in a 6DoF environment by an apparatus, the method comprising:

a decoding step of decoding a received audio signal and outputting the decoded audio signal and metadata;

a modeling step of checking whether a user's position is changed from a previous position by receiving an input of user position information and modeling a binaural rendering data to be related to the changed user position if the user position is changed; and a rendering step of outputting a 2-channel audio signal by binaural-rendering the decoded audio signal based on the modeled rendering data, wherein the user position information includes first flag information for indicating that the user position has been changed and information of at least one of azimuth, elevation, or distance related to the changed user position, wherein second flag information for indicating whether or not the 6DoF environment is supported is further received, and wherein the user position information is received based on the 6DoF environment supported by the second flag information.

2. The method of claim 1, the modeling step comprising:

a first modeling step of modeling Room Impulse Response (RIR) data by further receiving room characterization information; and a second modeling step of modeling Head-related Impulse Response (HRIR) data by further receiving user head information.

3. The method of claim 2, wherein the modeling step further comprises a distance compensation step of adjusting a gain of the second-modeled HRIR data based on the changed user position.

4. The method of claim 3, wherein the modeling step further comprises a Binaural Room Impulse Response (BRIR) synthesizing step of generating BRIR data related to the changed user position by synthesizing the distance-compensated HRIR data and the first-modeled RIR data.

5. The method of claim 1, further comprising a metadata processing step of receiving the user position information and adjusting the metadata to be related to the changed user position.

6. The method of claim 5, wherein the metadata processing step adjusts at least one of speaker layout information, zoom area, or audio scene to be related to the changed user position.

7. An apparatus for playing an audio in a 6DoF environment, the apparatus comprising:

an audio decoder to decode a received audio signal and output the decoded audio signal and metadata;

a modeling unit to check whether a user's position is changed from a previous position by receiving an input of user position information and model a binaural rendering data to be related to the changed user position based on the changed user position; and a binaural renderer to output a 2-channel audio signal by binaural-rendering the decoded audio signal based on the modeled rendering data, wherein the user position information includes first flag information for indicating that the user position has been changed and information of at least one of azimuth, elevation, or distance related to the changed user position, wherein second flag information for indicating whether or not the 6DoF environment is supported is further received, and wherein the user position information is received based on the 6DoF environment supported by the second flag information.

8. The apparatus of claim 7, the modeling unit further comprising:

a first modeling unit to model Room Impulse Response (RIR) data by further receiving room characterization information; and a second modeling unit to model Head-related Impulse Response (HRIR) data by further receiving user head information.

9. The apparatus of claim 8, wherein the modeling unit further comprises a distance compensation unit to adjust a gain of the second-modeled HRIR data based on the changed user position.

10. The apparatus of claim 9, wherein the modeling unit further comprises a Binaural Room Impulse Response (BRIR) synthesizing unit to generate BRIR data related to the changed user position by synthesizing the distance-compensated HRIR data and the first-modeled RIR data.

11. The apparatus of claim 7, further comprising a metadata processor to receive the user position information and adjust the metadata to be related to the changed user position.

12. The apparatus of claim 11, wherein the metadata processor adjusts at least one of speaker layout information, zoom area, or audio scene to be related to the changed user position.

* * * * *